US006722852B1

(12) United States Patent
Wedlake et al.

(10) Patent No.: US 6,722,852 B1
(45) Date of Patent: Apr. 20, 2004

(54) THIRD STAGE TURBINE BUCKET AIRFOIL

(75) Inventors: Raymond Allan Wedlake, Greenville, SC (US); David Alan Meier, Simpsonville, SC (US); Devin Martin, Piedmont, SC (US); Marvin Neeley, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 4 days.

(21) Appl. No.: 10/301,703

(22) Filed: Nov. 22, 2002

(51) Int. Cl.[7] ..... F01D 5/14

(52) U.S. Cl. ..... 416/223 A; 416/DIG. 2

(58) Field of Search ..... 416/243, DIG. 2, 416/DIG. 5, 223 A

*Primary Examiner*—Edward K. Look
*Assistant Examiner*—Kimya N McCoy
(74) *Attorney, Agent, or Firm*—Nixon & Vanderhye

(57) ABSTRACT

Third stage turbine buckets have airfoil profiles substantially in accordance with Cartesian coordinate values of X, Y and Z set forth Table I wherein X and Y values are in inches and the Z values are non-dimensional values from 0 to 1 convertible to Z distances in inches by multiplying the Z values by the height of the airfoil in inches. The X, Y and Z distances may be scalable as a function of the same constant or number to provide a scaled up or scaled down airfoil section for the bucket. The nominal airfoil given by the X, Y and Z distances lies within an envelop of ±0.160 inches in directions normal to the surface of the airfoil.

17 Claims, 4 Drawing Sheets

THIRD STAGE TURBINE BUCKET AIRFOIL

BACKGROUND OF THE INVENTION

The present invention relates to a turbine bucket for a gas turbine stage and particularly relates to a third stage turbine bucket airfoil profile.

In recent years, advanced gas turbines have trended toward increasing firing temperatures in order to meet system requirements of efficiency and loading. Consequently, the design and construction of turbine buckets require optimized aerodynamic efficiency as well as optimized aerodynamic and mechanical bucket loading.

BRIEF DESCRIPTION OF THE INVENTION

In accordance with a preferred embodiment of the present invention, there is provided a unique turbine bucket airfoil profile for the buckets of a turbine stage, preferably the third and final stage of a gas turbine. The bucket airfoil profile is defined by a unique loci of points to achieve the necessary efficiency and loading requirements whereby improved turbine performance is obtained. These unique loci of points define the nominal airfoil profile and are identified by the X, Y and Z Cartesian coordinates of Table I which follows. The 3600 points for the coordinate values shown in Table I are for a cold, i.e., room temperature profile at various cross-sections of the bucket airfoil along its length. The X and Y coordinates are given in distance dimensions, e.g., units of inches, and are joined smoothly at each Z location to form a smooth continuous airfoil cross-section. The Z coordinates are given in non-dimensionalized form from 0 to 1. By multiplying the airfoil height dimension, e.g., in inches, by the non-dimensional Z value of Table I, the airfoil shape, i.e., the profile, of the bucket is obtained. Each defined airfoil section in the X, Y plane is joined smoothly with adjacent airfoil sections in the Z direction to form the complete airfoil shape.

It will be appreciated that as each bucket airfoil heats up in use, the profile will change as a result of stress and temperature. Thus, the cold or room temperature profile is given by the X, Y and Z coordinates for manufacturing purposes. Because a manufactured bucket airfoil profile may be different from the nominal airfoil profile given by the following table, a distance of plus or minus 0.160 inches from the nominal profile in a direction normal to any surface location along the nominal profile and which includes any coating process, defines a profile envelope for this bucket airfoil. The airfoil shape is robust to this variation without impairment of the mechanical and aerodynamic functions.

It will also be appreciated that the airfoil can be scaled up or scaled down geometrically for introduction into similar turbine designs. Consequently, the X and Y coordinates in inches and the non-dimensional Z coordinates, when converted to inches, of the nominal airfoil profile given below may be a function of the same constant or number. That is, the X, Y and Z coordinate values in inches may be multiplied or divided by the same constant or number to provide a scaled up or scaled down version of the bucket airfoil profile while retaining the airfoil section shape.

In a preferred embodiment according to the present invention, there is provided a turbine bucket including an airfoil having an airfoil shape, the airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each distance Z, the profile sections at the Z distances being joined smoothly with one another to form a complete airfoil shape.

In a further preferred embodiment according to the present invention, there is provided a turbine bucket including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each Z distance, the profile sections at the Z distances being joined smoothly with one another to form a complete airfoil shape, the X, Y and Z distances being scalable as a function of the same constant or number to provide a scaled-up or scaled-down airfoil.

In a further preferred embodiment according to the present invention, there is provided a turbine comprising a turbine wheel having a plurality of buckets, each of the buckets including an airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define the airfoil profile sections at each distance Z, the profile sections at the Z distances being joined smoothly with one another to form a complete airfoil shape.

In a further preferred embodiment according to the present invention, there is provided a turbine comprising a turbine wheel having a plurality of buckets, each of the buckets including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each distance Z, the profile sections at the Z distances being joined smoothly with one another to form a complete airfoil shape, the X, Y and Z distances being scalable as a function of the same constant or number to provide a scaled-up or scaled-down bucket airfoil.

DETAILED DESCRIPTION OF THE INVENTION

Figure 1:
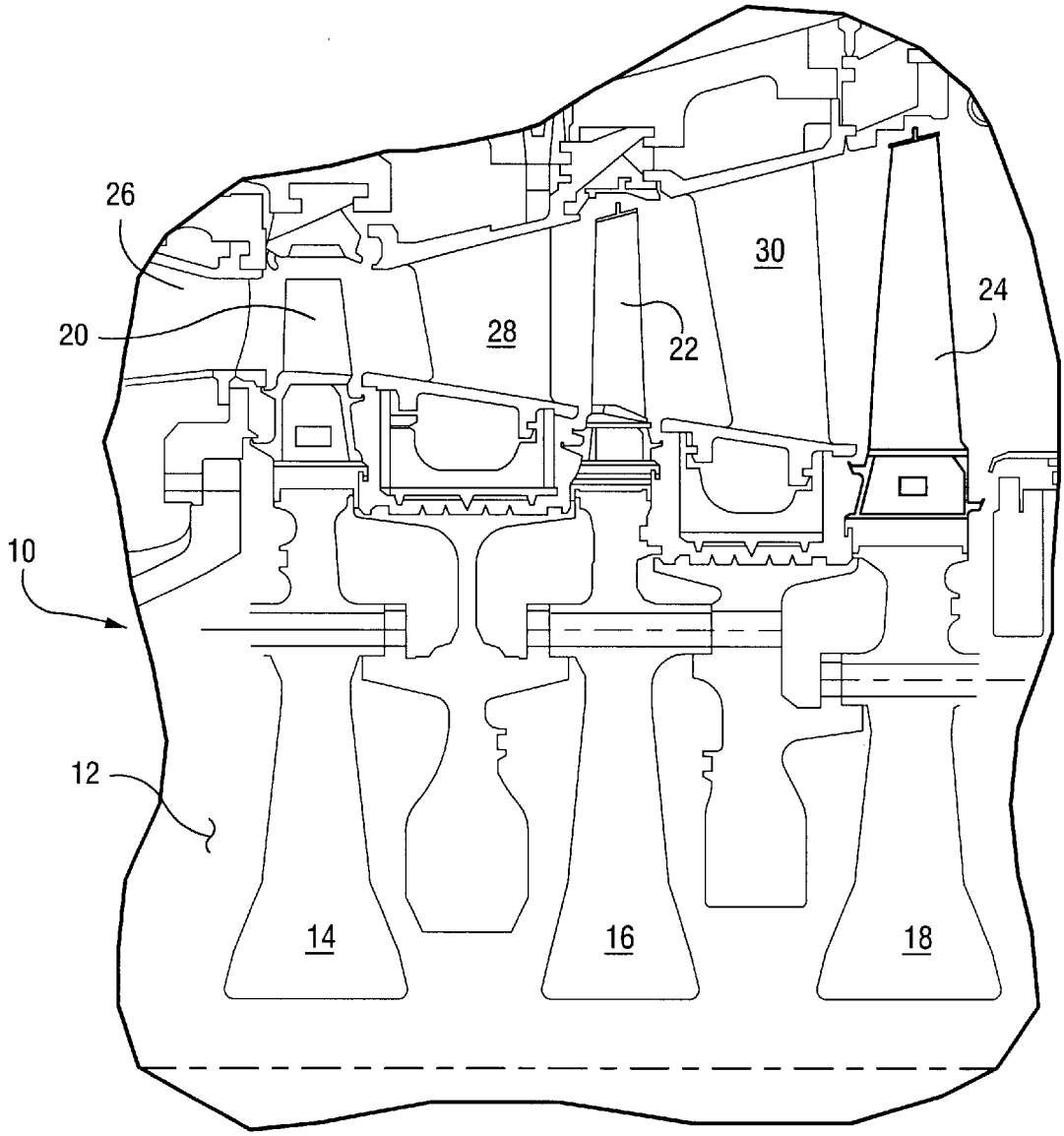
FIG. 1 is a schematic illustration of a turbine having a third stage turbine wheel which may employ the buckets and bucket airfoils hereof.

Referring now to FIG. 1, there is illustrated a portion of a turbine generally designated 10 in which a third stage turbine bucket 24 having an airfoil profile as defined herein may be utilized. Turbine 10 includes a rotor 12 having first, second and third stage rotor wheels 14, 16 and 18 having buckets 20, 22 and 24, respectively. Stator vanes 26, 28 and 30 also form part of the respective first, second and third stages of the rotor. It will therefore be appreciated that a three stage turbine is illustrated.

The third stage comprises the rotor wheel 18 on which buckets 24 are mounted in axial opposition to the upstream stator vanes 30. It will be appreciated that a plurality of the buckets 24 are spaced circumferentially one from the other about the third stage wheel 18. In this preferred embodiment, there are ninety-two buckets mounted on the third stage wheel 18.

Figure 2:
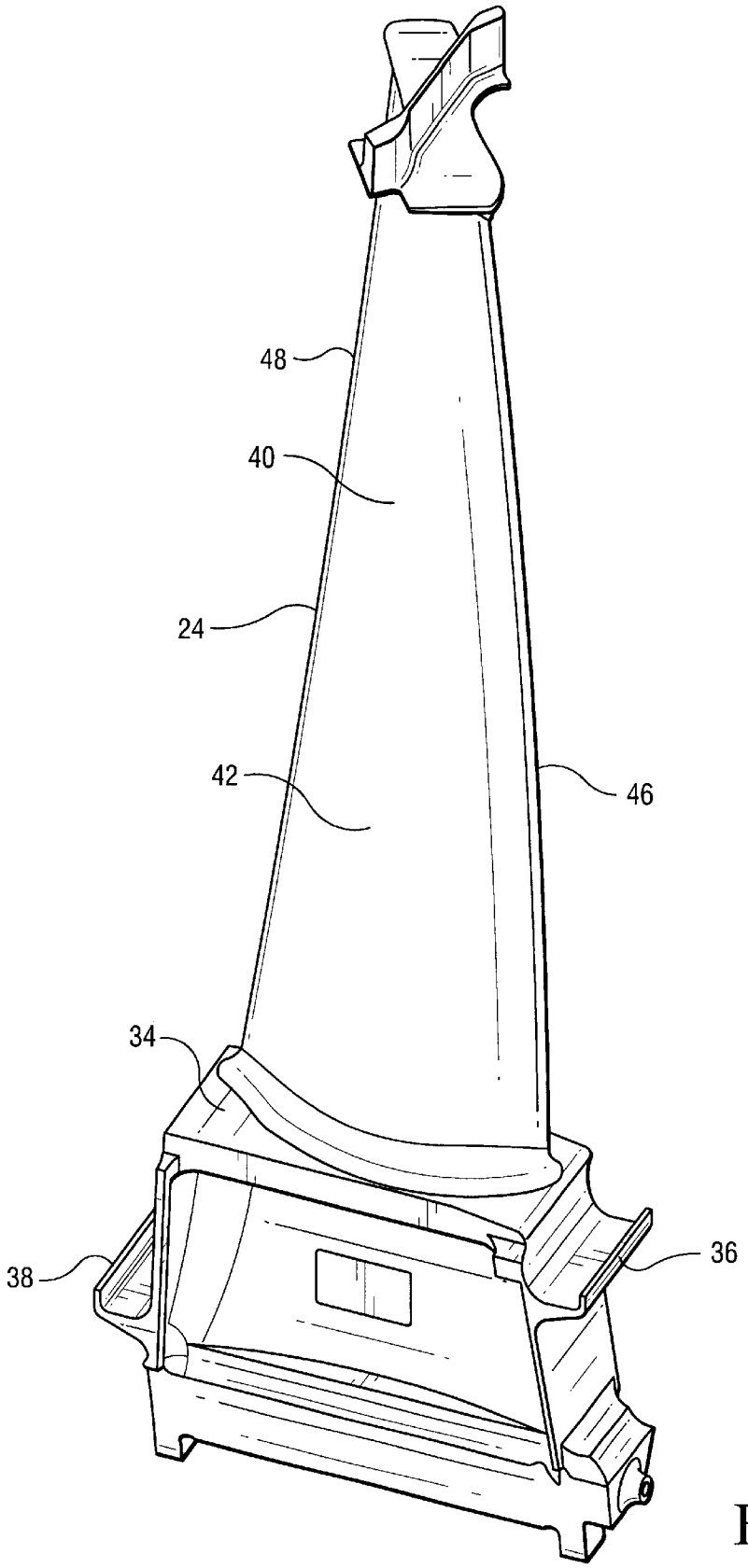
FIG. 2 is a top, trailing edge and pressure side perspective view of a third stage turbine bucket including an airfoil and a shank, the airfoil being in accordance with a preferred embodiment of the present invention.
Figure 3:
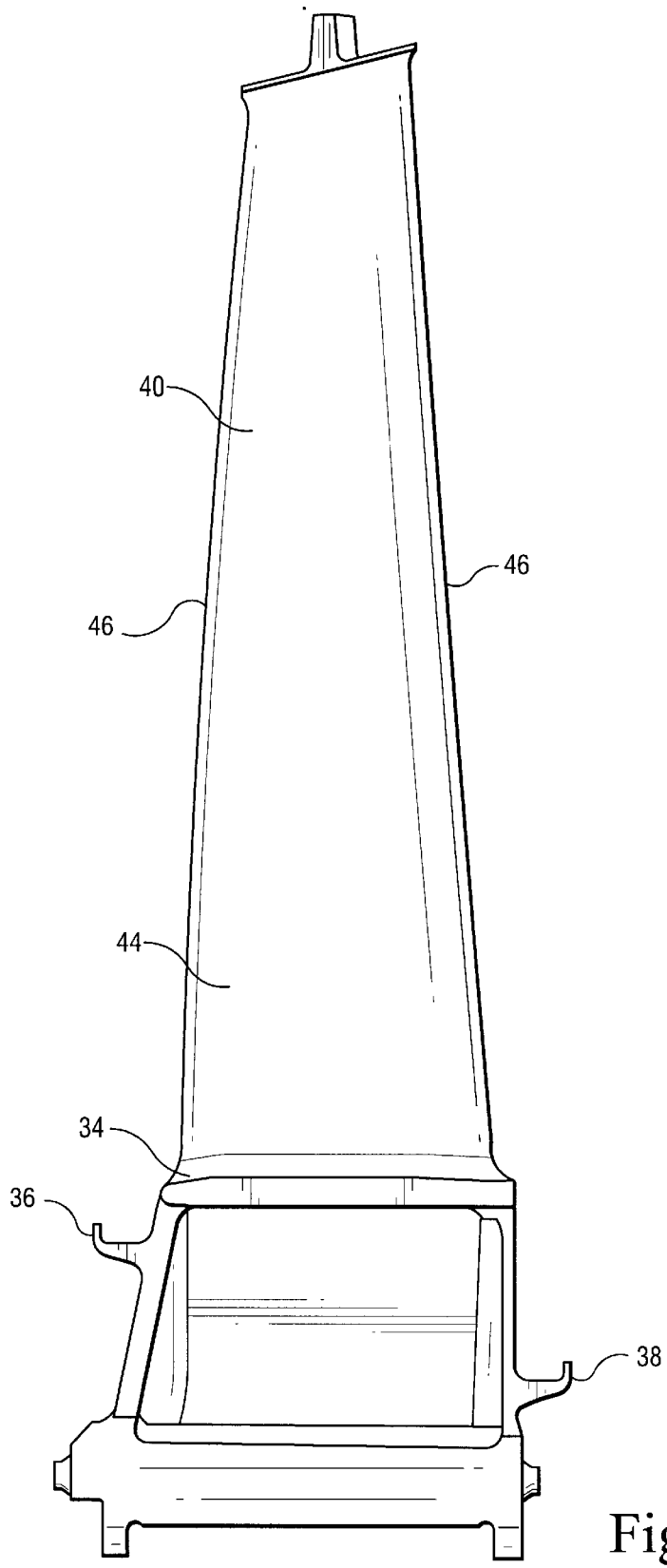
FIG. 3 is a side elevational view of the bucket including the airfoil hereof.
Figure 4:
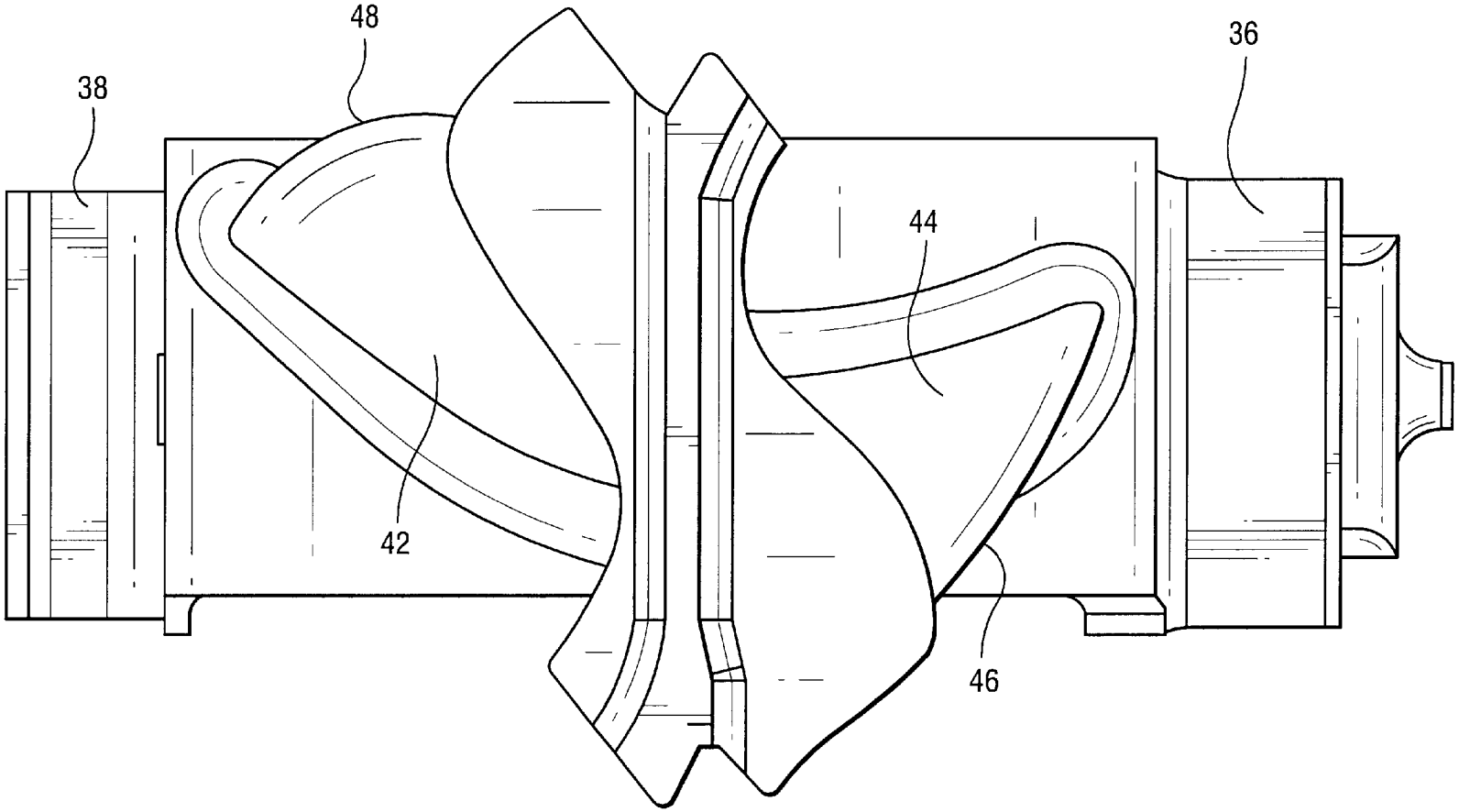
FIG. 4 is a top plan view thereof.

Referring now to FIG. 2, there is illustrated a turbine bucket 24 including an airfoil 40 constructed in accordance with the present invention mounted on a platform 34. The turbine bucket also includes forward and aft wheel space seals, i.e, angel wings 36 and 38, respectively. The buckets 24 are suitably mounted on the turbine wheel 18 by means, not shown. The airfoil 40 and platform 34 are collectively referred to as a bucket 24. The airfoil 40 has a profile including a compound curvature with suction and pressure sides 42 and 44, respectively, as well as a leading edge 46 and trailing edge 48.

A Cartesian coordinate system of X, Y and Z values given in Table I defines the profile of airfoil 40. The coordinate values for the X and Y coordinates are set forth in inches in Table I although other units of dimensions may be used when the values are appropriately converted. The Z values are set forth in Table I in non-dimensional form from 0 to 1. To convert the Z value to a Z coordinate value, e.g., in inches, the non-dimensional Z value given in the table is multiplied by the height of airfoil in inches. The airfoil height is measured from the intersection of the bucket centerline, which is along a radius from the centerline or axis of the turbine, and the root radius of the flowpath. The Z coordinate value of this intersection with the root radius for each bucket of the third stage in which the present airfoil may be used is 44.010 inches. The height of the third stage airfoil bucket from the root radius in this preferred airfoil embodiment is 21.46 inches. The Cartesian coordinate system has orthogonally-related X, Y and Z axes and the Y axis lies parallel to the turbine rotor centerline, i.e., the rotary axis.

By defining X and Y coordinate values at selected locations in a Z direction normal to the X, Y plane, the profile of airfoil 40 along its length in the Z direction can be ascertained. By connecting the X and Y values with smooth continuing arcs, each profile section at each distance Z is fixed. The surface profiles of the various surface locations between the distances Z are determined by smoothly connecting the adjacent profile sections to one another to form the airfoil. These values represent the airfoil profiles at ambient, non-operating or non-hot conditions and are for an uncoated airfoil. The sign convention assigns a positive value to Z values and positive and negative values for the X and Y coordinates as typically used in Cartesian coordinate systems.

The Table I values are generated and shown to three decimal places for determining the profile of the airfoil. There are typical manufacturing tolerances as well as coatings which must be accounted for in the actual profile of the airfoil. Accordingly, the values for the profile given in Table I are for a nominal airfoil. It will therefore be appreciated that ±typical manufacturing tolerances, i.e., ±values, including any coating thicknesses, are additive to the X and Y values given in Table I below. Accordingly, a distance of ±0.160 inches in a direction normal to any surface location along the airfoil profile defines an airfoil profile envelope for this particular bucket airfoil design and turbine.

The coordinate values given in Table I below provide the preferred nominal profile envelope.

TABLE I

| X | Y | Z' |
|---|---|---|
| −1.776 | 0.385 | 0.000 |
| −1.657 | 0.443 | 0.000 |
| −1.536 | 0.495 | 0.000 |
| −1.288 | 0.586 | 0.000 |
| −1.893 | 0.323 | 0.000 |
| −2.330 | 0.029 | 0.000 |
| −2.226 | 0.109 | 0.000 |
| −2.118 | 0.185 | 0.000 |
| −2.007 | 0.256 | 0.000 |
| −2.508 | −0.126 | 0.000 |
| −2.431 | −0.057 | 0.000 |
| −1.018 | 0.660 | 0.000 |
| −0.743 | 0.712 | 0.000 |
| −0.170 | 0.746 | 0.000 |
| −0.464 | 0.741 | 0.000 |
| 0.124 | 0.727 | 0.000 |
| −0.332 | −0.176 | 0.000 |
| 0.046 | −0.169 | 0.000 |
| −0.143 | −0.170 | 0.000 |
| 1.017 | 0.514 | 0.000 |
| 0.416 | 0.682 | 0.000 |
| 0.861 | 0.568 | 0.000 |
| 1.170 | 0.454 | 0.000 |
| 0.702 | 0.615 | 0.000 |
| 1.322 | 0.389 | 0.000 |
| 1.474 | 0.317 | 0.000 |
| 0.235 | −0.173 | 0.000 |
| 1.769 | 0.157 | 0.000 |
| 2.239 | −0.146 | 0.000 |
| 2.055 | −0.020 | 0.000 |
| 1.623 | 0.239 | 0.000 |
| 1.913 | 0.070 | 0.000 |
| −2.791 | −0.726 | 0.000 |
| −2.573 | −0.679 | 0.000 |
| −2.211 | −0.543 | 0.000 |
| −1.326 | −0.294 | 0.000 |
| −2.720 | −0.353 | 0.000 |
| −2.894 | −0.671 | 0.000 |
| −2.818 | −0.722 | 0.000 |
| −2.627 | −0.697 | 0.000 |
| −2.358 | −0.598 | 0.000 |
| −1.522 | −0.337 | 0.000 |
| −0.532 | −0.188 | 0.000 |
| −2.653 | −0.275 | 0.000 |
| −2.872 | −0.578 | 0.000 |
| −2.896 | −0.657 | 0.000 |
| −2.843 | −0.713 | 0.000 |
| −2.682 | −0.713 | 0.000 |
| −2.412 | −0.619 | 0.000 |
| −1.704 | −0.382 | 0.000 |
| −0.731 | −0.205 | 0.000 |
| −2.582 | −0.199 | 0.000 |
| −2.845 | −0.529 | 0.000 |
| −2.894 | −0.637 | 0.000 |
| −2.861 | −0.704 | 0.000 |
| −2.738 | −0.724 | 0.000 |
| −2.465 | −0.639 | 0.000 |
| −1.884 | −0.434 | 0.000 |
| −0.930 | −0.229 | 0.000 |
| −2.815 | −0.482 | 0.000 |
| −2.888 | −0.617 | 0.000 |
| −2.876 | −0.692 | 0.000 |
| −2.765 | −0.726 | 0.000 |
| −2.519 | −0.659 | 0.000 |
| −2.062 | −0.491 | 0.000 |
| −1.129 | −0.258 | 0.000 |
| −2.784 | −0.436 | 0.000 |
| −2.880 | −0.597 | 0.000 |

TABLE I-continued

| X | Y | Z' |
|---|---|---|
| −2.886 | −0.682 | 0.000 |
| 0.613 | −0.196 | 0.000 |
| 0.424 | −0.182 | 0.000 |
| 1.174 | −0.273 | 0.000 |
| 0.988 | −0.242 | 0.000 |
| 0.801 | −0.216 | 0.000 |
| 1.543 | −0.357 | 0.000 |
| 1.359 | −0.311 | 0.000 |
| 1.966 | −0.493 | 0.000 |
| 1.827 | −0.443 | 0.000 |
| 1.685 | −0.397 | 0.000 |
| 2.598 | −0.412 | 0.000 |
| 2.239 | −0.610 | 0.000 |
| 2.922 | −1.023 | 0.000 |
| 3.373 | −1.031 | 0.000 |
| 3.309 | −0.978 | 0.000 |
| 2.104 | −0.549 | 0.000 |
| 2.791 | −0.931 | 0.000 |
| 3.389 | −1.049 | 0.000 |
| 2.773 | −0.549 | 0.000 |
| 2.657 | −0.843 | 0.000 |
| 3.401 | −1.067 | 0.000 |
| 3.122 | −0.828 | 0.000 |
| 3.321 | −0.988 | 0.000 |
| 2.521 | −0.760 | 0.000 |
| 3.409 | −1.087 | 0.000 |
| 3.333 | −0.998 | 0.000 |
| 3.346 | −1.008 | 0.000 |
| 3.209 | −0.898 | 0.000 |
| 2.420 | −0.277 | 0.000 |
| 3.296 | −0.968 | 0.000 |
| 2.948 | −0.688 | 0.000 |
| 2.382 | −0.682 | 0.000 |
| 3.414 | −1.108 | 0.000 |
| 3.359 | −1.018 | 0.000 |
| 3.415 | −1.129 | 0.000 |
| 3.191 | −1.224 | 0.000 |
| 3.301 | −1.258 | 0.000 |
| 3.412 | −1.157 | 0.000 |
| 3.178 | −1.214 | 0.000 |
| 3.276 | −1.260 | 0.000 |
| 3.387 | −1.209 | 0.000 |
| 3.402 | −1.184 | 0.000 |
| 3.136 | −1.182 | 0.000 |
| 3.250 | −1.255 | 0.000 |
| 3.370 | −1.227 | 0.000 |
| 3.093 | −1.150 | 0.000 |
| 3.225 | −1.246 | 0.000 |
| 3.349 | −1.242 | 0.000 |
| 3.050 | −1.118 | 0.000 |
| 3.206 | −1.235 | 0.000 |
| 3.325 | −1.252 | 0.000 |
| −0.694 | 0.787 | 0.103 |
| −0.418 | 0.793 | 0.103 |
| −0.291 | 0.787 | 0.103 |
| −0.164 | 0.775 | 0.103 |
| −0.037 | 0.758 | 0.103 |
| −2.066 | 0.325 | 0.103 |
| −1.955 | 0.392 | 0.103 |
| −1.841 | 0.456 | 0.103 |
| −1.725 | 0.514 | 0.103 |
| −1.606 | 0.567 | 0.103 |
| −1.485 | 0.615 | 0.103 |
| −1.362 | 0.657 | 0.103 |
| −2.280 | 0.176 | 0.103 |
| −2.175 | 0.252 | 0.103 |
| −2.606 | −0.114 | 0.103 |
| −2.534 | −0.042 | 0.103 |
| −2.459 | 0.028 | 0.103 |
| −2.381 | 0.095 | 0.103 |
| −1.347 | −0.081 | 0.103 |
| −1.503 | −0.109 | 0.103 |
| −1.638 | −0.139 | 0.103 |
| −1.772 | −0.173 | 0.103 |
| −1.238 | 0.694 | 0.103 |
| −1.104 | 0.727 | 0.103 |
| −0.968 | 0.754 | 0.103 |

TABLE I-continued

| X | Y | Z' |
|---|---|---|
| 0.089 | 0.735 | 0.103 |
| 0.216 | 0.707 | 0.103 |
| −0.563 | −0.030 | 0.103 |
| −0.719 | −0.029 | 0.103 |
| −0.876 | −0.033 | 0.103 |
| −1.034 | −0.043 | 0.103 |
| −1.191 | −0.059 | 0.103 |
| 0.083 | −0.091 | 0.103 |
| −0.100 | −0.065 | 0.103 |
| −0.254 | −0.049 | 0.103 |
| −0.409 | −0.037 | 0.103 |
| 1.147 | 0.328 | 0.103 |
| 0.342 | 0.673 | 0.103 |
| 0.466 | 0.635 | 0.103 |
| 0.589 | 0.591 | 0.103 |
| 0.709 | 0.543 | 0.103 |
| 0.858 | 0.478 | 0.103 |
| 1.004 | 0.406 | 0.103 |
| 0.446 | −0.161 | 0.103 |
| 0.265 | −0.123 | 0.103 |
| 1.287 | 0.246 | 0.103 |
| 1.427 | 0.157 | 0.103 |
| 1.564 | 0.064 | 0.103 |
| 1.699 | −0.032 | 0.103 |
| 1.832 | −0.131 | 0.103 |
| −1.905 | −0.212 | 0.103 |
| −2.036 | −0.256 | 0.103 |
| −2.181 | −0.311 | 0.103 |
| −2.325 | −0.369 | 0.103 |
| −2.397 | −0.401 | 0.103 |
| −2.470 | −0.432 | 0.103 |
| −2.542 | −0.464 | 0.103 |
| −2.615 | −0.494 | 0.103 |
| −2.689 | −0.521 | 0.103 |
| −2.715 | −0.528 | 0.103 |
| −2.741 | −0.533 | 0.103 |
| −2.767 | −0.536 | 0.103 |
| −2.793 | −0.534 | 0.103 |
| −2.812 | −0.529 | 0.103 |
| −2.829 | −0.519 | 0.103 |
| −2.838 | −0.510 | 0.103 |
| −2.845 | −0.498 | 0.103 |
| −2.849 | −0.485 | 0.103 |
| −2.849 | −0.463 | 0.103 |
| −2.844 | −0.442 | 0.103 |
| −2.837 | −0.421 | 0.103 |
| −2.829 | −0.401 | 0.103 |
| −2.819 | −0.382 | 0.103 |
| −2.795 | −0.342 | 0.103 |
| −2.769 | −0.304 | 0.103 |
| −2.741 | −0.267 | 0.103 |
| −2.676 | −0.188 | 0.103 |
| 0.979 | −0.309 | 0.103 |
| 0.803 | −0.254 | 0.103 |
| 0.625 | −0.205 | 0.103 |
| 1.565 | −0.537 | 0.103 |
| 1.373 | −0.455 | 0.103 |
| 1.177 | −0.379 | 0.103 |
| 1.962 | −0.233 | 0.103 |
| 1.755 | −0.627 | 0.103 |
| 1.942 | −0.722 | 0.103 |
| 2.963 | −1.094 | 0.103 |
| 2.133 | −0.371 | 0.103 |
| 2.302 | −0.513 | 0.103 |
| 2.469 | −0.656 | 0.103 |
| 2.482 | −1.045 | 0.103 |
| 2.305 | −0.932 | 0.103 |
| 2.125 | −0.824 | 0.103 |
| 2.634 | −0.801 | 0.103 |
| 2.656 | −1.162 | 0.103 |
| 3.126 | −1.241 | 0.103 |
| 3.175 | −1.285 | 0.103 |
| 3.192 | −1.300 | 0.103 |
| 3.208 | −1.319 | 0.103 |
| 3.218 | −1.338 | 0.103 |
| 3.224 | −1.359 | 0.103 |
| 3.225 | −1.381 | 0.103 |

TABLE I-continued

| X | Y | Z' |
|---|---|---|
| 3.202 | −1.439 | 0.103 |
| 3.185 | −1.456 | 0.103 |
| 3.165 | −1.468 | 0.103 |
| 3.142 | −1.475 | 0.103 |
| 3.222 | −1.402 | 0.103 |
| 3.118 | −1.477 | 0.103 |
| 3.214 | −1.422 | 0.103 |
| 3.094 | −1.472 | 0.103 |
| 3.072 | −1.462 | 0.103 |
| 3.054 | −1.451 | 0.103 |
| 3.038 | −1.438 | 0.103 |
| 2.996 | −1.407 | 0.103 |
| 3.045 | −1.167 | 0.103 |
| 3.142 | −1.256 | 0.103 |
| 2.954 | −1.376 | 0.103 |
| 2.912 | −1.345 | 0.103 |
| 2.784 | −1.253 | 0.103 |
| 3.159 | −1.270 | 0.103 |
| −2.697 | −0.324 | 0.207 |
| −2.723 | −0.327 | 0.207 |
| −2.736 | −0.327 | 0.207 |
| −2.748 | −0.324 | 0.207 |
| −2.759 | −0.317 | 0.207 |
| −2.772 | −0.302 | 0.207 |
| −2.779 | −0.283 | 0.207 |
| −2.780 | −0.262 | 0.207 |
| −2.777 | −0.241 | 0.207 |
| −2.771 | −0.220 | 0.207 |
| −2.763 | −0.201 | 0.207 |
| −2.753 | −0.181 | 0.207 |
| −2.730 | −0.142 | 0.207 |
| −2.705 | −0.105 | 0.207 |
| −2.678 | −0.068 | 0.207 |
| −2.127 | −0.048 | 0.207 |
| −2.254 | −0.105 | 0.207 |
| −2.379 | −0.166 | 0.207 |
| −2.617 | 0.005 | 0.207 |
| −2.552 | 0.074 | 0.207 |
| −2.484 | 0.141 | 0.207 |
| −2.414 | 0.204 | 0.207 |
| −2.342 | 0.266 | 0.207 |
| −2.502 | −0.231 | 0.207 |
| −2.625 | −0.295 | 0.207 |
| −2.267 | 0.324 | 0.207 |
| −2.190 | 0.380 | 0.207 |
| −2.602 | −0.283 | 0.207 |
| −2.649 | −0.306 | 0.207 |
| −2.673 | −0.316 | 0.207 |
| −1.622 | 0.688 | 0.207 |
| −1.492 | 0.735 | 0.207 |
| −1.360 | 0.775 | 0.207 |
| −1.340 | 0.149 | 0.207 |
| −1.469 | 0.134 | 0.207 |
| −1.604 | 0.112 | 0.207 |
| −1.737 | 0.082 | 0.207 |
| −1.868 | 0.045 | 0.207 |
| −1.998 | 0.002 | 0.207 |
| −2.112 | 0.434 | 0.207 |
| −1.994 | 0.507 | 0.207 |
| −1.873 | 0.574 | 0.207 |
| −1.749 | 0.634 | 0.207 |
| −0.542 | 0.115 | 0.207 |
| −0.693 | 0.137 | 0.207 |
| −1.226 | 0.808 | 0.207 |
| −1.101 | 0.831 | 0.207 |
| −0.976 | 0.847 | 0.207 |
| −0.822 | 0.150 | 0.207 |
| −0.849 | 0.857 | 0.207 |
| −0.095 | 0.014 | 0.207 |
| −0.723 | 0.860 | 0.207 |
| −0.596 | 0.856 | 0.207 |
| −0.952 | 0.158 | 0.207 |
| −0.243 | 0.053 | 0.207 |
| −0.470 | 0.846 | 0.207 |
| −0.333 | 0.828 | 0.207 |
| −0.197 | 0.803 | 0.207 |
| −0.063 | 0.770 | 0.207 |

TABLE I-continued

| X | Y | Z' |
|---|---|---|
| −1.081 | 0.161 | 0.207 |
| −0.392 | 0.087 | 0.207 |
| 0.070 | 0.731 | 0.207 |
| 0.201 | 0.686 | 0.207 |
| 0.080 | −0.038 | 0.207 |
| −1.211 | 0.158 | 0.207 |
| 0.592 | 0.512 | 0.207 |
| 0.855 | 0.361 | 0.207 |
| 0.725 | 0.439 | 0.207 |
| 1.791 | −0.859 | 0.207 |
| 1.108 | 0.192 | 0.207 |
| 1.264 | 0.077 | 0.207 |
| 1.416 | −0.042 | 0.207 |
| 1.579 | −0.731 | 0.207 |
| 1.363 | −0.608 | 0.207 |
| 1.566 | −0.165 | 0.207 |
| 1.712 | −0.291 | 0.207 |
| 1.145 | −0.490 | 0.207 |
| 0.923 | −0.379 | 0.207 |
| 0.758 | −0.302 | 0.207 |
| 0.591 | −0.229 | 0.207 |
| 0.252 | −0.097 | 0.207 |
| 0.983 | 0.278 | 0.207 |
| 0.423 | −0.161 | 0.207 |
| 0.329 | 0.635 | 0.207 |
| 0.456 | 0.579 | 0.207 |
| 2.000 | −0.993 | 0.207 |
| 2.070 | −0.613 | 0.207 |
| 1.857 | −0.419 | 0.207 |
| 2.280 | −0.810 | 0.207 |
| 2.488 | −1.009 | 0.207 |
| 2.511 | −1.345 | 0.207 |
| 2.342 | −1.225 | 0.207 |
| 2.172 | −1.107 | 0.207 |
| 3.036 | −1.587 | 0.207 |
| 3.012 | −1.522 | 0.207 |
| 2.921 | −1.431 | 0.207 |
| 2.951 | −1.461 | 0.207 |
| 2.966 | −1.477 | 0.207 |
| 2.650 | −1.166 | 0.207 |
| 3.016 | −1.633 | 0.207 |
| 3.026 | −1.619 | 0.207 |
| 3.032 | −1.553 | 0.207 |
| 3.002 | −1.645 | 0.207 |
| 2.986 | −1.654 | 0.207 |
| 2.968 | −1.659 | 0.207 |
| 2.949 | −1.660 | 0.207 |
| 2.930 | −1.656 | 0.207 |
| 2.913 | −1.648 | 0.207 |
| 3.033 | −1.603 | 0.207 |
| 2.897 | −1.637 | 0.207 |
| 2.882 | −1.625 | 0.207 |
| 2.797 | −1.310 | 0.207 |
| 2.841 | −1.593 | 0.207 |
| 2.800 | −1.562 | 0.207 |
| 2.759 | −1.530 | 0.207 |
| 2.981 | −1.492 | 0.207 |
| 2.636 | −1.437 | 0.207 |
| 3.025 | −1.538 | 0.207 |
| 3.036 | −1.570 | 0.207 |
| 2.997 | −1.507 | 0.207 |
| −2.246 | 0.124 | 0.310 |
| −2.345 | 0.068 | 0.310 |
| −2.644 | −0.094 | 0.310 |
| −2.656 | −0.092 | 0.310 |
| −2.657 | 0.049 | 0.310 |
| −2.635 | 0.087 | 0.310 |
| −2.584 | 0.159 | 0.310 |
| −2.442 | 0.008 | 0.310 |
| −2.539 | −0.053 | 0.310 |
| −2.666 | −0.085 | 0.310 |
| −2.674 | −0.075 | 0.310 |
| −2.611 | 0.124 | 0.310 |
| −2.533 | 0.222 | 0.310 |
| −2.560 | −0.066 | 0.310 |
| −2.582 | −0.079 | 0.310 |
| −2.680 | −0.063 | 0.310 |

TABLE I-continued

| X | Y | Z' |
|---|---|---|
| −2.684 | −0.051 | 0.310 |
| −2.477 | 0.281 | 0.310 |
| −2.419 | 0.338 | 0.310 |
| −2.358 | 0.393 | 0.310 |
| −2.517 | −0.040 | 0.310 |
| −2.606 | −0.089 | 0.310 |
| −2.684 | −0.030 | 0.310 |
| −2.680 | −0.009 | 0.310 |
| −2.279 | 0.459 | 0.310 |
| −2.196 | 0.521 | 0.310 |
| −2.111 | 0.580 | 0.310 |
| −2.631 | −0.094 | 0.310 |
| −2.674 | 0.011 | 0.310 |
| −2.666 | 0.030 | 0.310 |
| −2.145 | 0.176 | 0.310 |
| −1.707 | 0.791 | 0.310 |
| −1.597 | 0.832 | 0.310 |
| −1.484 | 0.867 | 0.310 |
| −1.370 | 0.896 | 0.310 |
| −1.410 | 0.370 | 0.310 |
| −1.517 | 0.361 | 0.310 |
| −1.623 | 0.345 | 0.310 |
| −1.729 | 0.323 | 0.310 |
| −1.832 | 0.296 | 0.310 |
| −1.935 | 0.263 | 0.310 |
| −2.023 | 0.635 | 0.310 |
| −1.920 | 0.692 | 0.310 |
| −1.815 | 0.745 | 0.310 |
| −2.041 | 0.222 | 0.310 |
| −0.509 | 0.243 | 0.310 |
| −0.653 | 0.286 | 0.310 |
| −1.254 | 0.918 | 0.310 |
| −0.759 | 0.312 | 0.310 |
| −0.866 | 0.335 | 0.310 |
| −1.138 | 0.934 | 0.310 |
| −1.015 | 0.943 | 0.310 |
| −0.891 | 0.945 | 0.310 |
| −0.974 | 0.352 | 0.310 |
| −0.768 | 0.939 | 0.310 |
| −1.083 | 0.365 | 0.310 |
| −1.192 | 0.373 | 0.310 |
| −0.646 | 0.927 | 0.310 |
| −0.524 | 0.907 | 0.310 |
| −0.403 | 0.881 | 0.310 |
| −1.301 | 0.374 | 0.310 |
| −0.274 | 0.845 | 0.310 |
| −0.146 | 0.802 | 0.310 |
| −0.021 | 0.753 | 0.310 |
| 0.233 | −0.079 | 0.310 |
| 0.102 | 0.698 | 0.310 |
| 0.073 | 0.002 | 0.310 |
| 0.222 | 0.638 | 0.310 |
| −0.089 | 0.078 | 0.310 |
| −0.227 | 0.138 | 0.310 |
| −0.367 | 0.193 | 0.310 |
| 0.937 | 0.159 | 0.310 |
| 1.051 | 0.066 | 0.310 |
| 1.230 | −0.088 | 0.310 |
| 1.621 | −0.934 | 0.310 |
| 1.368 | −0.764 | 0.310 |
| 1.577 | −0.406 | 0.310 |
| 1.112 | −0.597 | 0.310 |
| 0.854 | −0.436 | 0.310 |
| 0.700 | −0.343 | 0.310 |
| 1.405 | −0.245 | 0.310 |
| 0.546 | −0.252 | 0.310 |
| 0.390 | −0.164 | 0.310 |
| 1.746 | −0.570 | 0.310 |
| 0.340 | 0.573 | 0.310 |
| 0.456 | 0.504 | 0.310 |
| 0.580 | 0.423 | 0.310 |
| 0.701 | 0.339 | 0.310 |
| 0.820 | 0.250 | 0.310 |
| 2.745 | −1.591 | 0.310 |
| 2.850 | −1.739 | 0.310 |
| 2.817 | −1.668 | 0.310 |
| 2.360 | −1.474 | 0.310 |

TABLE I-continued

| X | Y | Z' |
|---|---|---|
| 2.199 | −1.349 | 0.310 |
| 2.772 | −1.799 | 0.310 |
| 2.036 | −1.228 | 0.310 |
| 2.751 | −1.793 | 0.310 |
| 1.871 | −1.109 | 0.310 |
| 2.543 | −1.378 | 0.310 |
| 2.788 | −1.637 | 0.310 |
| 2.844 | −1.760 | 0.310 |
| 2.831 | −1.682 | 0.310 |
| 2.849 | −1.717 | 0.310 |
| 2.733 | −1.781 | 0.310 |
| 2.717 | −1.561 | 0.310 |
| 2.774 | −1.622 | 0.310 |
| 2.630 | −1.469 | 0.310 |
| 2.714 | −1.764 | 0.310 |
| 2.339 | −1.165 | 0.310 |
| 2.045 | −0.865 | 0.310 |
| 2.803 | −1.653 | 0.310 |
| 2.675 | −1.731 | 0.310 |
| 2.636 | −1.698 | 0.310 |
| 2.832 | −1.778 | 0.310 |
| 2.760 | −1.606 | 0.310 |
| 2.842 | −1.697 | 0.310 |
| 2.597 | −1.666 | 0.310 |
| 2.479 | −1.569 | 0.310 |
| 2.814 | −1.792 | 0.310 |
| 2.794 | −1.799 | 0.310 |
| −2.550 | 0.260 | 0.414 |
| −2.482 | 0.153 | 0.414 |
| −2.501 | 0.149 | 0.414 |
| −2.540 | 0.277 | 0.414 |
| −2.530 | 0.294 | 0.414 |
| −2.521 | 0.151 | 0.414 |
| −2.534 | 0.154 | 0.414 |
| −2.506 | 0.329 | 0.414 |
| −2.480 | 0.362 | 0.414 |
| −2.553 | 0.168 | 0.414 |
| −2.110 | 0.675 | 0.414 |
| −2.452 | 0.394 | 0.414 |
| −2.390 | 0.458 | 0.414 |
| −2.563 | 0.184 | 0.414 |
| −2.567 | 0.203 | 0.414 |
| −2.096 | 0.363 | 0.414 |
| −2.181 | 0.321 | 0.414 |
| −2.264 | 0.274 | 0.414 |
| −2.544 | 0.160 | 0.414 |
| −2.324 | 0.517 | 0.414 |
| −2.255 | 0.573 | 0.414 |
| −2.345 | 0.225 | 0.414 |
| −2.564 | 0.222 | 0.414 |
| −2.558 | 0.241 | 0.414 |
| −2.427 | 0.177 | 0.414 |
| −2.445 | 0.168 | 0.414 |
| −2.463 | 0.159 | 0.414 |
| −2.183 | 0.626 | 0.414 |
| −2.034 | 0.722 | 0.414 |
| −1.956 | 0.765 | 0.414 |
| −1.877 | 0.805 | 0.414 |
| −1.773 | 0.850 | 0.414 |
| −1.668 | 0.891 | 0.414 |
| −1.560 | 0.925 | 0.414 |
| −1.451 | 0.954 | 0.414 |
| −1.418 | 0.538 | 0.414 |
| −1.522 | 0.529 | 0.414 |
| −1.626 | 0.514 | 0.414 |
| −1.340 | 0.976 | 0.414 |
| −1.728 | 0.493 | 0.414 |
| −1.829 | 0.466 | 0.414 |
| −1.920 | 0.437 | 0.414 |
| −2.009 | 0.402 | 0.414 |
| −0.994 | 0.512 | 0.414 |
| −1.100 | 0.527 | 0.414 |
| −1.206 | 0.537 | 0.414 |
| −1.313 | 0.540 | 0.414 |
| −1.228 | 0.993 | 0.414 |
| −1.116 | 1.003 | 0.414 |
| −1.003 | 1.006 | 0.414 |

TABLE I-continued

| X | Y | Z' |
|---|---|---|
| −0.885 | 1.002 | 0.414 |
| −0.767 | 0.991 | 0.414 |
| −0.650 | 0.973 | 0.414 |
| −0.534 | 0.947 | 0.414 |
| −0.420 | 0.916 | 0.414 |
| −0.308 | 0.878 | 0.414 |
| 0.095 | 0.058 | 0.414 |
| −0.055 | 0.148 | 0.414 |
| −0.188 | 0.829 | 0.414 |
| −0.183 | 0.219 | 0.414 |
| −0.071 | 0.775 | 0.414 |
| −0.314 | 0.285 | 0.414 |
| 0.044 | 0.715 | 0.414 |
| 0.156 | 0.650 | 0.414 |
| −0.447 | 0.346 | 0.414 |
| −0.583 | 0.400 | 0.414 |
| −0.684 | 0.435 | 0.414 |
| −0.786 | 0.466 | 0.414 |
| −0.890 | 0.491 | 0.414 |
| 0.750 | 0.206 | 0.414 |
| 0.882 | 0.088 | 0.414 |
| 1.012 | −0.034 | 0.414 |
| 1.175 | −0.191 | 0.414 |
| 1.334 | −0.351 | 0.414 |
| 1.491 | −0.513 | 0.414 |
| 1.750 | −1.172 | 0.414 |
| 0.968 | −0.561 | 0.414 |
| 1.439 | −0.926 | 0.414 |
| 1.792 | −0.832 | 0.414 |
| 1.126 | −0.682 | 0.414 |
| 0.811 | −0.442 | 0.414 |
| 1.602 | −1.054 | 0.414 |
| 0.671 | −0.338 | 0.414 |
| 0.530 | −0.235 | 0.414 |
| 0.387 | −0.134 | 0.414 |
| 1.647 | −0.677 | 0.414 |
| 0.242 | −0.037 | 0.414 |
| 0.265 | 0.581 | 0.414 |
| 0.371 | 0.507 | 0.414 |
| 1.286 | −0.806 | 0.414 |
| 0.475 | 0.431 | 0.414 |
| 0.614 | 0.321 | 0.414 |
| 2.594 | −1.884 | 0.414 |
| 2.339 | −1.433 | 0.414 |
| 2.576 | −1.878 | 0.414 |
| 2.560 | −1.866 | 0.414 |
| 2.542 | −1.849 | 0.414 |
| 2.487 | −1.798 | 0.414 |
| 2.648 | −1.868 | 0.414 |
| 2.432 | −1.749 | 0.414 |
| 2.660 | −1.852 | 0.414 |
| 2.062 | −1.126 | 0.414 |
| 2.321 | −1.649 | 0.414 |
| 2.209 | −1.551 | 0.414 |
| 2.624 | −1.753 | 0.414 |
| 1.981 | −1.360 | 0.414 |
| 2.611 | −1.737 | 0.414 |
| 2.638 | −1.768 | 0.414 |
| 2.597 | −1.722 | 0.414 |
| 2.463 | −1.572 | 0.414 |
| 2.194 | −1.271 | 0.414 |
| 1.922 | −0.973 | 0.414 |
| 2.096 | −1.456 | 0.414 |
| 2.633 | −1.879 | 0.414 |
| 2.660 | −1.796 | 0.414 |
| 2.666 | −1.814 | 0.414 |
| 2.614 | −1.885 | 0.414 |
| 2.666 | −1.833 | 0.414 |
| 2.651 | −1.782 | 0.414 |
| 1.876 | −1.273 | 0.414 |
| −1.879 | 0.560 | 0.517 |
| −1.969 | 0.529 | 0.517 |
| −2.017 | 0.510 | 0.517 |
| −2.065 | 0.490 | 0.517 |
| −2.112 | 0.469 | 0.517 |
| −2.159 | 0.447 | 0.517 |
| −2.205 | 0.425 | 0.517 |

TABLE I-continued

| X | Y | Z' |
|---|---|---|
| −2.252 | 0.403 | 0.517 |
| −2.301 | 0.385 | 0.517 |
| −2.319 | 0.380 | 0.517 |
| −2.338 | 0.378 | 0.517 |
| −2.358 | 0.379 | 0.517 |
| −2.376 | 0.384 | 0.517 |
| −2.392 | 0.395 | 0.517 |
| −2.404 | 0.408 | 0.517 |
| −2.414 | 0.423 | 0.517 |
| −2.419 | 0.434 | 0.517 |
| −2.422 | 0.446 | 0.517 |
| −2.422 | 0.458 | 0.517 |
| −2.416 | 0.475 | 0.517 |
| −2.407 | 0.490 | 0.517 |
| −2.397 | 0.505 | 0.517 |
| −2.386 | 0.520 | 0.517 |
| −2.354 | 0.555 | 0.517 |
| −2.320 | 0.589 | 0.517 |
| −2.283 | 0.620 | 0.517 |
| −2.207 | 0.678 | 0.517 |
| −2.126 | 0.731 | 0.517 |
| −2.042 | 0.780 | 0.517 |
| −1.956 | 0.824 | 0.517 |
| −1.869 | 0.864 | 0.517 |
| −1.779 | 0.900 | 0.517 |
| −1.788 | 0.587 | 0.517 |
| −1.570 | 0.966 | 0.517 |
| −1.450 | 0.993 | 0.517 |
| −1.329 | 1.014 | 0.517 |
| −1.207 | 1.027 | 0.517 |
| −1.084 | 1.033 | 0.517 |
| −1.191 | 0.645 | 0.517 |
| −1.293 | 0.649 | 0.517 |
| −1.394 | 0.647 | 0.517 |
| −1.496 | 0.640 | 0.517 |
| −1.596 | 0.627 | 0.517 |
| −1.688 | 0.931 | 0.517 |
| −1.696 | 0.609 | 0.517 |
| −0.109 | 0.289 | 0.517 |
| −0.233 | 0.358 | 0.517 |
| −0.400 | 0.924 | 0.517 |
| −0.490 | 0.480 | 0.517 |
| −0.602 | 0.523 | 0.517 |
| −0.294 | 0.885 | 0.517 |
| −0.360 | 0.422 | 0.517 |
| −0.717 | 0.560 | 0.517 |
| −0.191 | 0.839 | 0.517 |
| −0.081 | 0.785 | 0.517 |
| −0.834 | 0.591 | 0.517 |
| −0.952 | 0.616 | 0.517 |
| −1.071 | 0.634 | 0.517 |
| 0.026 | 0.724 | 0.517 |
| 0.130 | 0.659 | 0.517 |
| −0.839 | 1.023 | 0.517 |
| −0.727 | 1.008 | 0.517 |
| −0.961 | 1.032 | 0.517 |
| 0.153 | 0.119 | 0.517 |
| 0.231 | 0.590 | 0.517 |
| −0.616 | 0.986 | 0.517 |
| −0.507 | 0.958 | 0.517 |
| 0.012 | 0.214 | 0.517 |
| 1.020 | −0.613 | 0.517 |
| 0.426 | 0.439 | 0.517 |
| 0.520 | 0.360 | 0.517 |
| 0.807 | −0.417 | 0.517 |
| 0.681 | −0.304 | 0.517 |
| 0.646 | 0.246 | 0.517 |
| 0.767 | 0.129 | 0.517 |
| 0.553 | −0.194 | 0.517 |
| 0.423 | −0.086 | 0.517 |
| 0.886 | 0.009 | 0.517 |
| 1.003 | −0.114 | 0.517 |
| 1.333 | −0.908 | 0.517 |
| 0.289 | 0.019 | 0.517 |
| 1.196 | −0.326 | 0.517 |
| 1.293 | −0.435 | 0.517 |
| 1.230 | −0.811 | 0.517 |

TABLE I-continued

| X | Y | Z' |
|---|---|---|
| 0.330 | 0.516 | 0.517 |
| 2.190 | −1.502 | 0.517 |
| 2.277 | −1.803 | 0.517 |
| 1.486 | −0.659 | 0.517 |
| 2.489 | −1.862 | 0.517 |
| 1.752 | −1.304 | 0.517 |
| 2.174 | −1.702 | 0.517 |
| 1.936 | −1.195 | 0.517 |
| 2.494 | −1.878 | 0.517 |
| 2.309 | −1.644 | 0.517 |
| 2.432 | −1.791 | 0.517 |
| 1.818 | −1.053 | 0.517 |
| 2.063 | −1.349 | 0.517 |
| 2.444 | −1.806 | 0.517 |
| 1.701 | −0.914 | 0.517 |
| 2.070 | −1.602 | 0.517 |
| 2.476 | −1.927 | 0.517 |
| 2.462 | −1.936 | 0.517 |
| 2.487 | −1.913 | 0.517 |
| 2.456 | −1.821 | 0.517 |
| 1.967 | −1.505 | 0.517 |
| 1.859 | −1.404 | 0.517 |
| 1.385 | −0.541 | 0.517 |
| 2.444 | −1.941 | 0.517 |
| 1.649 | −1.207 | 0.517 |
| 2.427 | −1.940 | 0.517 |
| 2.411 | −1.934 | 0.517 |
| 2.469 | −1.835 | 0.517 |
| 2.481 | −1.849 | 0.517 |
| 1.546 | −1.109 | 0.517 |
| 2.493 | −1.896 | 0.517 |
| 1.439 | −1.009 | 0.517 |
| 1.571 | −0.759 | 0.517 |
| 2.396 | −1.921 | 0.517 |
| 2.379 | −1.904 | 0.517 |
| 2.328 | −1.853 | 0.517 |
| −1.876 | 0.697 | 0.621 |
| −1.924 | 0.683 | 0.621 |
| −1.972 | 0.668 | 0.621 |
| −2.019 | 0.653 | 0.621 |
| −2.067 | 0.637 | 0.621 |
| −2.115 | 0.621 | 0.621 |
| −2.164 | 0.610 | 0.621 |
| −2.187 | 0.609 | 0.621 |
| −2.210 | 0.612 | 0.621 |
| −2.225 | 0.617 | 0.621 |
| −2.237 | 0.626 | 0.621 |
| −2.247 | 0.638 | 0.621 |
| −2.254 | 0.650 | 0.621 |
| −2.260 | 0.663 | 0.621 |
| −2.264 | 0.676 | 0.621 |
| −2.267 | 0.690 | 0.621 |
| −2.265 | 0.703 | 0.621 |
| −2.257 | 0.718 | 0.621 |
| −2.247 | 0.732 | 0.621 |
| −2.236 | 0.745 | 0.621 |
| −2.223 | 0.757 | 0.621 |
| −2.189 | 0.787 | 0.621 |
| −2.152 | 0.814 | 0.621 |
| −1.689 | 1.017 | 0.621 |
| −1.600 | 1.040 | 0.621 |
| −1.509 | 1.058 | 0.621 |
| −1.393 | 1.076 | 0.621 |
| −1.276 | 1.087 | 0.621 |
| −1.188 | 0.765 | 0.621 |
| −1.159 | 1.092 | 0.621 |
| −1.311 | 0.771 | 0.621 |
| −1.434 | 0.770 | 0.621 |
| −1.557 | 0.760 | 0.621 |
| −1.648 | 0.748 | 0.621 |
| −1.738 | 0.731 | 0.621 |
| −1.828 | 0.710 | 0.621 |
| −2.113 | 0.839 | 0.621 |
| −2.033 | 0.885 | 0.621 |
| −1.950 | 0.925 | 0.621 |
| −1.864 | 0.960 | 0.621 |
| −1.778 | 0.990 | 0.621 |

TABLE I-continued

| X | Y | Z' |
|---|---|---|
| −0.808 | 1.065 | 0.621 |
| −0.693 | 1.042 | 0.621 |
| −0.589 | 1.015 | 0.621 |
| −0.486 | 0.982 | 0.621 |
| −0.385 | 0.944 | 0.621 |
| −0.924 | 1.080 | 0.621 |
| −0.287 | 0.901 | 0.621 |
| −0.190 | 0.853 | 0.621 |
| 0.199 | 0.151 | 0.621 |
| −0.096 | 0.801 | 0.621 |
| 0.020 | 0.728 | 0.621 |
| 0.132 | 0.649 | 0.621 |
| 0.069 | 0.253 | 0.621 |
| −0.043 | 0.333 | 0.621 |
| −0.158 | 0.409 | 0.621 |
| −0.277 | 0.479 | 0.621 |
| −0.399 | 0.543 | 0.621 |
| −0.505 | 0.592 | 0.621 |
| −0.613 | 0.635 | 0.621 |
| −0.724 | 0.674 | 0.621 |
| −0.836 | 0.706 | 0.621 |
| −0.950 | 0.732 | 0.621 |
| −1.066 | 0.752 | 0.621 |
| −1.042 | 1.089 | 0.621 |
| 1.361 | −1.032 | 0.621 |
| 1.172 | −0.825 | 0.621 |
| 0.984 | −0.618 | 0.621 |
| 0.793 | −0.414 | 0.621 |
| 1.263 | −0.544 | 0.621 |
| 0.679 | −0.295 | 0.621 |
| 0.564 | −0.179 | 0.621 |
| 0.445 | −0.065 | 0.621 |
| 0.324 | 0.045 | 0.621 |
| 0.345 | 0.477 | 0.621 |
| 0.446 | 0.384 | 0.621 |
| 0.545 | 0.289 | 0.621 |
| 0.672 | 0.157 | 0.621 |
| 0.888 | −0.514 | 0.621 |
| 1.080 | −0.723 | 0.621 |
| 0.796 | 0.021 | 0.621 |
| 0.916 | −0.118 | 0.621 |
| 1.033 | −0.258 | 0.621 |
| 1.149 | −0.401 | 0.621 |
| 1.269 | −0.931 | 0.621 |
| 0.240 | 0.565 | 0.621 |
| 2.302 | −1.988 | 0.621 |
| 1.550 | −1.238 | 0.621 |
| 2.318 | −1.926 | 0.621 |
| 1.642 | −1.337 | 0.621 |
| 2.225 | −1.979 | 0.621 |
| 1.376 | −0.689 | 0.621 |
| 1.711 | −1.126 | 0.621 |
| 1.933 | −1.418 | 0.621 |
| 2.210 | −1.961 | 0.621 |
| 2.195 | −1.944 | 0.621 |
| 1.488 | −0.834 | 0.621 |
| 1.809 | −1.254 | 0.621 |
| 2.155 | −1.710 | 0.621 |
| 2.294 | −1.893 | 0.621 |
| 2.239 | −1.819 | 0.621 |
| 2.118 | −1.856 | 0.621 |
| 1.607 | −0.988 | 0.621 |
| 2.280 | −1.874 | 0.621 |
| 2.320 | −1.960 | 0.621 |
| 2.207 | −1.778 | 0.621 |
| 2.024 | −1.751 | 0.621 |
| 1.838 | −1.548 | 0.621 |
| 1.930 | −1.648 | 0.621 |
| 2.313 | −1.976 | 0.621 |
| 2.058 | −1.582 | 0.621 |
| 1.453 | −1.132 | 0.621 |
| 2.266 | −1.856 | 0.621 |
| 1.740 | −1.443 | 0.621 |
| 2.287 | −1.997 | 0.621 |
| 2.308 | −1.910 | 0.621 |
| 2.270 | −2.000 | 0.621 |
| 2.253 | −1.998 | 0.621 |

TABLE I-continued

| X | Y | Z' |
|---|---|---|
| 2.322 | −1.943 | 0.621 |
| 2.238 | −1.991 | 0.621 |
| −2.099 | 0.901 | 0.724 |
| −2.103 | 0.915 | 0.724 |
| −2.105 | 0.928 | 0.724 |
| −1.968 | 0.864 | 0.724 |
| −2.105 | 0.941 | 0.724 |
| −2.102 | 0.954 | 0.724 |
| −1.826 | 0.896 | 0.724 |
| −2.086 | 0.876 | 0.724 |
| −2.092 | 0.967 | 0.724 |
| −2.081 | 0.980 | 0.724 |
| −2.069 | 0.991 | 0.724 |
| −2.056 | 1.001 | 0.724 |
| −2.075 | 0.866 | 0.724 |
| −2.020 | 1.026 | 0.724 |
| −1.982 | 1.048 | 0.724 |
| −1.943 | 1.067 | 0.724 |
| −1.872 | 1.098 | 0.724 |
| −2.039 | 0.857 | 0.724 |
| −1.799 | 1.123 | 0.724 |
| −1.779 | 0.905 | 0.724 |
| −2.016 | 0.857 | 0.724 |
| −1.874 | 0.886 | 0.724 |
| −1.921 | 0.875 | 0.724 |
| −2.061 | 0.860 | 0.724 |
| −2.094 | 0.889 | 0.724 |
| −1.594 | 0.931 | 0.724 |
| −1.506 | 0.936 | 0.724 |
| −1.683 | 0.921 | 0.724 |
| −1.417 | 0.938 | 0.724 |
| −1.298 | 0.933 | 0.724 |
| −1.179 | 0.920 | 0.724 |
| −1.731 | 0.914 | 0.724 |
| −1.724 | 1.145 | 0.724 |
| −1.649 | 1.163 | 0.724 |
| −1.573 | 1.177 | 0.724 |
| −1.497 | 1.188 | 0.724 |
| −1.420 | 1.196 | 0.724 |
| −1.343 | 1.200 | 0.724 |
| −1.230 | 1.201 | 0.724 |
| −1.118 | 1.195 | 0.724 |
| −1.007 | 1.183 | 0.724 |
| −0.896 | 1.164 | 0.724 |
| −0.626 | 0.760 | 0.724 |
| −0.327 | 0.598 | 0.724 |
| −0.524 | 0.711 | 0.724 |
| −0.786 | 1.139 | 0.724 |
| −0.837 | 0.842 | 0.724 |
| −0.678 | 1.108 | 0.724 |
| −0.005 | 0.361 | 0.724 |
| −1.062 | 0.901 | 0.724 |
| −0.572 | 1.070 | 0.724 |
| −0.424 | 0.657 | 0.724 |
| −0.459 | 1.021 | 0.724 |
| −0.348 | 0.966 | 0.724 |
| −0.109 | 0.445 | 0.724 |
| −0.241 | 0.905 | 0.724 |
| −0.945 | 0.874 | 0.724 |
| −0.730 | 0.804 | 0.724 |
| −0.137 | 0.837 | 0.724 |
| −0.037 | 0.765 | 0.724 |
| −0.216 | 0.524 | 0.724 |
| 0.066 | 0.683 | 0.724 |
| 0.165 | 0.597 | 0.724 |
| 0.211 | 0.164 | 0.724 |
| 0.096 | 0.273 | 0.724 |
| 1.323 | −1.124 | 0.724 |
| 0.786 | −0.089 | 0.724 |
| 0.443 | 0.319 | 0.724 |
| 1.205 | −0.981 | 0.724 |
| 0.976 | −0.702 | 0.724 |
| 0.908 | −0.248 | 0.724 |
| 0.746 | −0.424 | 0.724 |
| 0.643 | −0.302 | 0.724 |
| 0.861 | −0.562 | 0.724 |
| 1.029 | −0.408 | 0.724 |

TABLE I-continued

| X | Y | Z' |
|---|---|---|
| 0.539 | −0.182 | 0.724 |
| 0.433 | −0.064 | 0.724 |
| 1.088 | −0.838 | 0.724 |
| 0.530 | 0.221 | 0.724 |
| 0.324 | 0.052 | 0.724 |
| 0.261 | 0.508 | 0.724 |
| 0.353 | 0.415 | 0.724 |
| 0.660 | 0.067 | 0.724 |
| 1.266 | −0.732 | 0.724 |
| 1.148 | −0.570 | 0.724 |
| 1.435 | −1.259 | 0.724 |
| 1.789 | −1.469 | 0.724 |
| 1.695 | −1.334 | 0.724 |
| 1.479 | −1.029 | 0.724 |
| 2.116 | −2.034 | 0.724 |
| 2.089 | −1.902 | 0.724 |
| 1.692 | −1.572 | 0.724 |
| 2.128 | −2.022 | 0.724 |
| 2.039 | −1.829 | 0.724 |
| 1.989 | −1.757 | 0.724 |
| 2.127 | −1.955 | 0.724 |
| 1.886 | −1.608 | 0.724 |
| 2.136 | −1.972 | 0.724 |
| 2.064 | −1.865 | 0.724 |
| 1.587 | −1.181 | 0.724 |
| 1.383 | −0.895 | 0.724 |
| 2.100 | −2.042 | 0.724 |
| 2.083 | −2.044 | 0.724 |
| 2.114 | −1.938 | 0.724 |
| 2.066 | −2.041 | 0.724 |
| 2.051 | −2.033 | 0.724 |
| 2.038 | −2.019 | 0.724 |
| 2.136 | −2.006 | 0.724 |
| 1.523 | −1.365 | 0.724 |
| 2.025 | −2.001 | 0.724 |
| 1.985 | −1.946 | 0.724 |
| 1.944 | −1.892 | 0.724 |
| 2.101 | −1.920 | 0.724 |
| 1.862 | −1.785 | 0.724 |
| 1.778 | −1.679 | 0.724 |
| 1.901 | −1.836 | 0.724 |
| 2.139 | −1.989 | 0.724 |
| 1.937 | −1.682 | 0.724 |
| 1.607 | −1.468 | 0.724 |
| 2.006 | −1.974 | 0.724 |
| −1.845 | 1.109 | 0.828 |
| −1.172 | 1.104 | 0.828 |
| −1.787 | 1.287 | 0.828 |
| −1.263 | 1.121 | 0.828 |
| −1.747 | 1.301 | 0.828 |
| −1.666 | 1.324 | 0.828 |
| −1.584 | 1.341 | 0.828 |
| −1.911 | 1.212 | 0.828 |
| −1.916 | 1.162 | 0.828 |
| −1.888 | 1.234 | 0.828 |
| −1.348 | 1.132 | 0.828 |
| −1.500 | 1.351 | 0.828 |
| −1.433 | 1.138 | 0.828 |
| −1.416 | 1.356 | 0.828 |
| −1.332 | 1.355 | 0.828 |
| −1.248 | 1.351 | 0.828 |
| −1.917 | 1.175 | 0.828 |
| −1.909 | 1.135 | 0.828 |
| −1.914 | 1.149 | 0.828 |
| −1.900 | 1.224 | 0.828 |
| −1.752 | 1.119 | 0.828 |
| −1.900 | 1.124 | 0.828 |
| −1.519 | 1.139 | 0.828 |
| −1.566 | 1.138 | 0.828 |
| −1.164 | 1.341 | 0.828 |
| −1.875 | 1.243 | 0.828 |
| −1.862 | 1.251 | 0.828 |
| −1.916 | 1.201 | 0.828 |
| −1.867 | 1.110 | 0.828 |
| −1.613 | 1.135 | 0.828 |
| −1.659 | 1.131 | 0.828 |
| −1.825 | 1.271 | 0.828 |

TABLE I-continued

| X | Y | Z' |
|---|---|---|
| −1.917 | 1.188 | 0.828 |
| −1.888 | 1.116 | 0.828 |
| −1.083 | 1.082 | 0.828 |
| −1.706 | 1.125 | 0.828 |
| −1.798 | 1.112 | 0.828 |
| −0.078 | 0.469 | 0.828 |
| −0.172 | 0.557 | 0.828 |
| −0.270 | 0.640 | 0.828 |
| −0.089 | 0.802 | 0.828 |
| −0.003 | 0.722 | 0.828 |
| 0.103 | 0.615 | 0.828 |
| −0.356 | 0.708 | 0.828 |
| −0.445 | 0.772 | 0.828 |
| 0.205 | 0.505 | 0.828 |
| −0.536 | 0.833 | 0.828 |
| −0.629 | 0.890 | 0.828 |
| −1.059 | 1.323 | 0.828 |
| −0.955 | 1.298 | 0.828 |
| 0.226 | 0.149 | 0.828 |
| −0.725 | 0.941 | 0.828 |
| −0.824 | 0.988 | 0.828 |
| −0.853 | 1.267 | 0.828 |
| −0.752 | 1.230 | 0.828 |
| −0.654 | 1.187 | 0.828 |
| −0.558 | 1.139 | 0.828 |
| 0.103 | 0.286 | 0.828 |
| 0.014 | 0.379 | 0.828 |
| −0.908 | 1.024 | 0.828 |
| −0.995 | 1.055 | 0.828 |
| −0.465 | 1.086 | 0.828 |
| −0.366 | 1.022 | 0.828 |
| −0.271 | 0.953 | 0.828 |
| −0.178 | 0.880 | 0.828 |
| 1.191 | −0.818 | 0.828 |
| 1.071 | −0.942 | 0.828 |
| 1.158 | −1.057 | 0.828 |
| 1.313 | −1.262 | 0.828 |
| 0.998 | −0.845 | 0.828 |
| 1.046 | −0.608 | 0.828 |
| 0.303 | 0.392 | 0.828 |
| 0.917 | −0.737 | 0.828 |
| 0.398 | 0.276 | 0.828 |
| 0.684 | −0.427 | 0.828 |
| 0.573 | −0.280 | 0.828 |
| 0.460 | −0.135 | 0.828 |
| 1.268 | −0.932 | 0.828 |
| 0.491 | 0.158 | 0.828 |
| 0.653 | −0.056 | 0.828 |
| 1.117 | −0.711 | 0.828 |
| 0.344 | 0.008 | 0.828 |
| 1.364 | −1.074 | 0.828 |
| 0.834 | −0.627 | 0.828 |
| 1.245 | −1.172 | 0.828 |
| 0.965 | −0.491 | 0.828 |
| 0.883 | −0.374 | 0.828 |
| 0.810 | −0.272 | 0.828 |
| 0.731 | −0.162 | 0.828 |
| 0.752 | −0.517 | 0.828 |
| 0.574 | 0.051 | 0.828 |
| 1.640 | −1.489 | 0.828 |
| 1.700 | −1.788 | 0.828 |
| 1.958 | −1.978 | 0.828 |
| 1.624 | −1.681 | 0.828 |
| 1.949 | −1.961 | 0.828 |
| 1.937 | −2.039 | 0.828 |
| 1.915 | −1.909 | 0.828 |
| 1.740 | −1.642 | 0.828 |
| 1.470 | −1.471 | 0.828 |
| 1.455 | −1.210 | 0.828 |
| 1.555 | −1.586 | 0.828 |
| 1.540 | −1.337 | 0.828 |
| 1.830 | −1.976 | 0.828 |
| 1.921 | −2.047 | 0.828 |
| 1.949 | −2.028 | 0.828 |
| 1.903 | −2.048 | 0.828 |
| 1.384 | −1.356 | 0.828 |
| 1.886 | −2.044 | 0.828 |

TABLE I-continued

| X | Y | Z' |
|---|---|---|
| 1.958 | −2.012 | 0.828 |
| 1.926 | −1.927 | 0.828 |
| 1.872 | −2.036 | 0.828 |
| 1.860 | −2.021 | 0.828 |
| 1.961 | −1.995 | 0.828 |
| 1.848 | −2.003 | 0.828 |
| 1.824 | −1.769 | 0.828 |
| 1.938 | −1.944 | 0.828 |
| 1.893 | −1.874 | 0.828 |
| 1.811 | −1.949 | 0.828 |
| 1.774 | −1.895 | 0.828 |
| −1.698 | 1.402 | 0.931 |
| −1.701 | 1.417 | 0.931 |
| −1.702 | 1.433 | 0.931 |
| −1.699 | 1.448 | 0.931 |
| −1.348 | 1.539 | 0.931 |
| −1.693 | 1.461 | 0.931 |
| −1.679 | 1.475 | 0.931 |
| −1.645 | 1.497 | 0.931 |
| −1.082 | 1.268 | 0.931 |
| −1.158 | 1.297 | 0.931 |
| −1.237 | 1.320 | 0.931 |
| −1.608 | 1.511 | 0.931 |
| −1.570 | 1.522 | 0.931 |
| −1.532 | 1.530 | 0.931 |
| −1.471 | 1.538 | 0.931 |
| −1.316 | 1.339 | 0.931 |
| −1.378 | 1.349 | 0.931 |
| −1.607 | 1.365 | 0.931 |
| −1.663 | 1.487 | 0.931 |
| −1.440 | 1.357 | 0.931 |
| −1.502 | 1.362 | 0.931 |
| −1.409 | 1.541 | 0.931 |
| −1.286 | 1.534 | 0.931 |
| −1.209 | 1.522 | 0.931 |
| −1.565 | 1.364 | 0.931 |
| −1.627 | 1.366 | 0.931 |
| −1.648 | 1.369 | 0.931 |
| −1.668 | 1.375 | 0.931 |
| −1.133 | 1.505 | 0.931 |
| −1.681 | 1.381 | 0.931 |
| −1.691 | 1.390 | 0.931 |
| −0.846 | 1.152 | 0.931 |
| −0.799 | 1.373 | 0.931 |
| −0.711 | 1.323 | 0.931 |
| −0.923 | 1.195 | 0.931 |
| 0.221 | 0.397 | 0.931 |
| −1.001 | 1.234 | 0.931 |
| −0.626 | 1.268 | 0.931 |
| −0.543 | 1.208 | 0.931 |
| 0.227 | 0.101 | 0.931 |
| 0.091 | 0.273 | 0.931 |
| −0.013 | 0.400 | 0.931 |
| −0.463 | 1.145 | 0.931 |
| −0.386 | 1.079 | 0.931 |
| −0.120 | 0.523 | 0.931 |
| −0.231 | 0.644 | 0.931 |
| −0.319 | 0.733 | 0.931 |
| −0.284 | 0.984 | 0.931 |
| −0.186 | 0.884 | 0.931 |
| −0.409 | 0.819 | 0.931 |
| −0.502 | 0.903 | 0.931 |
| −0.599 | 0.982 | 0.931 |
| 0.112 | 0.537 | 0.931 |
| −0.092 | 0.781 | 0.931 |
| −1.057 | 1.484 | 0.931 |
| −0.984 | 1.458 | 0.931 |
| −0.001 | 0.675 | 0.931 |
| −0.890 | 1.419 | 0.931 |
| −0.699 | 1.056 | 0.931 |
| −0.772 | 1.105 | 0.931 |
| 0.688 | −0.530 | 0.931 |
| 1.151 | −0.937 | 0.931 |
| 1.337 | −1.445 | 0.931 |
| 0.975 | −0.672 | 0.931 |
| 1.193 | −1.241 | 0.931 |
| 0.904 | −0.835 | 0.931 |

TABLE I-continued

| X | Y | Z' |
|---|---|---|
| 1.263 | −1.340 | 0.931 |
| 0.488 | −0.251 | 0.931 |
| 0.759 | −0.630 | 0.931 |
| 1.050 | −1.040 | 0.931 |
| 0.359 | −0.074 | 0.931 |
| 1.324 | −1.202 | 0.931 |
| 1.123 | −1.142 | 0.931 |
| 0.327 | 0.254 | 0.931 |
| 1.241 | −1.075 | 0.931 |
| 1.059 | −0.799 | 0.931 |
| 0.978 | −0.938 | 0.931 |
| 0.432 | 0.110 | 0.931 |
| 0.616 | −0.149 | 0.931 |
| 0.829 | −0.729 | 0.931 |
| 0.527 | −0.022 | 0.931 |
| 0.797 | −0.410 | 0.931 |
| 0.888 | −0.544 | 0.931 |
| 0.616 | −0.429 | 0.931 |
| 0.704 | −0.276 | 0.931 |
| 1.478 | −1.649 | 0.931 |
| 1.707 | −1.992 | 0.931 |
| 1.530 | −1.727 | 0.931 |
| 1.796 | −1.953 | 0.931 |
| 1.699 | −1.784 | 0.931 |
| 1.794 | −1.936 | 0.931 |
| 1.545 | −1.545 | 0.931 |
| 1.696 | −1.978 | 0.931 |
| 1.753 | −1.870 | 0.931 |
| 1.793 | −1.970 | 0.931 |
| 1.556 | −1.765 | 0.931 |
| 1.496 | −1.469 | 0.931 |
| 1.447 | −1.604 | 0.931 |
| 1.685 | −1.961 | 0.931 |
| 1.774 | −1.903 | 0.931 |
| 1.784 | −1.985 | 0.931 |
| 1.785 | −1.919 | 0.931 |
| 1.504 | −1.688 | 0.931 |
| 1.406 | −1.329 | 0.931 |
| 1.668 | −1.736 | 0.931 |
| 1.651 | −1.909 | 0.931 |
| 1.772 | −1.997 | 0.931 |
| 1.756 | −2.004 | 0.931 |
| 1.582 | −1.805 | 0.931 |
| 1.617 | −1.857 | 0.931 |
| 1.372 | −1.495 | 0.931 |
| 1.739 | −2.005 | 0.931 |
| 1.722 | −2.001 | 0.931 |
| 1.586 | −1.609 | 0.931 |
| 1.732 | −1.837 | 0.931 |
| 1.410 | −1.549 | 0.931 |
| 1.764 | −1.887 | 0.931 |
| 1.614 | −1.653 | 0.931 |
| 1.448 | −1.393 | 0.931 |
| 1.637 | −1.688 | 0.931 |
| −0.449 | 0.759 | 0.034 |
| −0.156 | 0.756 | 0.034 |
| −1.759 | 0.425 | 0.034 |
| −1.640 | 0.481 | 0.034 |
| −1.519 | 0.532 | 0.034 |
| −1.396 | 0.579 | 0.034 |
| −1.989 | 0.298 | 0.034 |
| −1.272 | 0.620 | 0.034 |
| −1.875 | 0.364 | 0.034 |
| −2.313 | 0.073 | 0.034 |
| −2.208 | 0.153 | 0.034 |
| −2.100 | 0.227 | 0.034 |
| −2.566 | −0.151 | 0.034 |
| −2.491 | −0.079 | 0.034 |
| −2.414 | −0.010 | 0.034 |
| −1.138 | 0.658 | 0.034 |
| −1.002 | 0.690 | 0.034 |
| −0.727 | 0.737 | 0.034 |
| 0.136 | 0.726 | 0.034 |
| −0.635 | −0.140 | 0.034 |
| −0.812 | −0.153 | 0.034 |
| −0.989 | −0.172 | 0.034 |
| 0.085 | −0.141 | 0.034 |

TABLE I-continued

| X | Y | Z' |
|---|---|---|
| −0.101 | −0.133 | 0.034 |
| −0.279 | −0.130 | 0.034 |
| −0.457 | −0.133 | 0.034 |
| 1.014 | 0.479 | 0.034 |
| 0.281 | 0.702 | 0.034 |
| 1.165 | 0.413 | 0.034 |
| 0.424 | 0.671 | 0.034 |
| 0.566 | 0.635 | 0.034 |
| 0.706 | 0.593 | 0.034 |
| 0.862 | 0.539 | 0.034 |
| 1.313 | 0.341 | 0.034 |
| 0.271 | −0.155 | 0.034 |
| 0.457 | −0.175 | 0.034 |
| 1.748 | 0.093 | 0.034 |
| 2.026 | −0.093 | 0.034 |
| 1.888 | 0.002 | 0.034 |
| 1.460 | 0.263 | 0.034 |
| 1.605 | 0.180 | 0.034 |
| −2.770 | −0.383 | 0.034 |
| −1.697 | −0.307 | 0.034 |
| −2.874 | −0.561 | 0.034 |
| −2.053 | −0.416 | 0.034 |
| −2.201 | −0.469 | 0.034 |
| −2.706 | −0.302 | 0.034 |
| −2.400 | −0.546 | 0.034 |
| −2.866 | −0.540 | 0.034 |
| −2.453 | −0.568 | 0.034 |
| −2.506 | −0.588 | 0.034 |
| −2.612 | −0.629 | 0.034 |
| −2.637 | −0.225 | 0.034 |
| −2.666 | −0.646 | 0.034 |
| −2.857 | −0.520 | 0.034 |
| −2.722 | −0.659 | 0.034 |
| −2.748 | −0.663 | 0.034 |
| −2.826 | −0.657 | 0.034 |
| −2.559 | −0.609 | 0.034 |
| −2.846 | −0.500 | 0.034 |
| −2.845 | −0.649 | 0.034 |
| −1.515 | −0.263 | 0.034 |
| −2.861 | −0.638 | 0.034 |
| −2.801 | −0.663 | 0.034 |
| −2.871 | −0.629 | 0.034 |
| −1.876 | −0.358 | 0.034 |
| −2.810 | −0.441 | 0.034 |
| −2.878 | −0.617 | 0.034 |
| −1.166 | −0.197 | 0.034 |
| −2.881 | −0.604 | 0.034 |
| −1.341 | −0.227 | 0.034 |
| −2.879 | −0.582 | 0.034 |
| −2.347 | −0.525 | 0.034 |
| −2.774 | −0.665 | 0.034 |
| 1.008 | −0.267 | 0.034 |
| 0.825 | −0.230 | 0.034 |
| 0.641 | −0.200 | 0.034 |
| 1.874 | −0.533 | 0.034 |
| 1.705 | −0.467 | 0.034 |
| 1.533 | −0.408 | 0.034 |
| 1.360 | −0.355 | 0.034 |
| 1.184 | −0.308 | 0.034 |
| 3.256 | −1.074 | 0.034 |
| 2.557 | −0.496 | 0.034 |
| 3.270 | −1.086 | 0.034 |
| 2.729 | −0.636 | 0.034 |
| 3.284 | −1.098 | 0.034 |
| 3.071 | −0.919 | 0.034 |
| 2.878 | −1.103 | 0.034 |
| 2.748 | −1.011 | 0.034 |
| 2.616 | −0.923 | 0.034 |
| 2.481 | −0.839 | 0.034 |
| 3.299 | −1.109 | 0.034 |
| 3.156 | −0.991 | 0.034 |
| 2.344 | −0.760 | 0.034 |
| 2.206 | −0.223 | 0.034 |
| 2.203 | −0.685 | 0.034 |
| 2.040 | −0.606 | 0.034 |
| 3.242 | −1.062 | 0.034 |
| 2.383 | −0.358 | 0.034 |

TABLE I-continued

| X | Y | Z' |
|---|---|---|
| 3.341 | −1.266 | 0.034 |
| 3.330 | −1.142 | 0.034 |
| 3.328 | −1.288 | 0.034 |
| 3.307 | −1.308 | 0.034 |
| 3.282 | −1.323 | 0.034 |
| 3.254 | −1.332 | 0.034 |
| 3.226 | −1.334 | 0.034 |
| 3.344 | −1.165 | 0.034 |
| 3.202 | −1.330 | 0.034 |
| 3.180 | −1.321 | 0.034 |
| 3.162 | −1.311 | 0.034 |
| 3.147 | −1.301 | 0.034 |
| 3.135 | −1.291 | 0.034 |
| 3.092 | −1.259 | 0.034 |
| 3.351 | −1.190 | 0.034 |
| 3.050 | −1.228 | 0.034 |
| 3.007 | −1.196 | 0.034 |
| 3.353 | −1.215 | 0.034 |
| 3.350 | −1.241 | 0.034 |
| 3.314 | −1.123 | 0.034 |
| −1.085 | 0.764 | 0.138 |
| −0.950 | 0.787 | 0.138 |
| −0.813 | 0.803 | 0.138 |
| −0.676 | 0.812 | 0.138 |
| −0.539 | 0.814 | 0.138 |
| −0.402 | 0.809 | 0.138 |
| −0.276 | 0.798 | 0.138 |
| −0.150 | 0.781 | 0.138 |
| −0.024 | 0.759 | 0.138 |
| −2.156 | 0.308 | 0.138 |
| −2.048 | 0.379 | 0.138 |
| −1.707 | 0.563 | 0.138 |
| −1.588 | 0.614 | 0.138 |
| −1.467 | 0.660 | 0.138 |
| −1.344 | 0.700 | 0.138 |
| −1.937 | 0.446 | 0.138 |
| −1.823 | 0.507 | 0.138 |
| −2.026 | −0.172 | 0.138 |
| −2.658 | −0.126 | 0.138 |
| −2.589 | −0.052 | 0.138 |
| −2.516 | 0.019 | 0.138 |
| −2.441 | 0.087 | 0.138 |
| −2.363 | 0.153 | 0.138 |
| −2.262 | 0.233 | 0.138 |
| −1.895 | −0.129 | 0.138 |
| −1.339 | −0.004 | 0.138 |
| −1.494 | −0.029 | 0.138 |
| −1.629 | −0.057 | 0.138 |
| −1.763 | −0.090 | 0.138 |
| −1.219 | 0.734 | 0.138 |
| 0.100 | 0.731 | 0.138 |
| 0.225 | 0.698 | 0.138 |
| −0.558 | 0.020 | 0.138 |
| −0.712 | 0.028 | 0.138 |
| −0.869 | 0.030 | 0.138 |
| −1.026 | 0.025 | 0.138 |
| −1.183 | 0.014 | 0.138 |
| −0.251 | −0.012 | 0.138 |
| −0.404 | 0.007 | 0.138 |
| 0.082 | −0.070 | 0.138 |
| −0.098 | −0.036 | 0.138 |
| 0.348 | 0.659 | 0.138 |
| 0.470 | 0.616 | 0.138 |
| 0.708 | 0.515 | 0.138 |
| 0.853 | 0.444 | 0.138 |
| 0.996 | 0.366 | 0.138 |
| 0.590 | 0.568 | 0.138 |
| 1.135 | 0.284 | 0.138 |
| 0.439 | −0.158 | 0.138 |
| 0.262 | −0.111 | 0.138 |
| 1.271 | 0.197 | 0.138 |
| 1.441 | 0.080 | 0.138 |
| 1.607 | −0.042 | 0.138 |
| 1.769 | −0.168 | 0.138 |
| −2.305 | −0.284 | 0.138 |
| −2.578 | −0.410 | 0.138 |
| −2.670 | −0.448 | 0.138 |

TABLE I-continued

| X | Y | Z' |
|---|---|---|
| −2.810 | −0.338 | 0.138 |
| −2.487 | −0.368 | 0.138 |
| −2.800 | −0.318 | 0.138 |
| −2.777 | −0.279 | 0.138 |
| −2.119 | −0.207 | 0.138 |
| −2.825 | −0.378 | 0.138 |
| −2.695 | −0.456 | 0.138 |
| −2.646 | −0.438 | 0.138 |
| −2.751 | −0.241 | 0.138 |
| −2.723 | −0.204 | 0.138 |
| −2.721 | −0.463 | 0.138 |
| −2.746 | −0.468 | 0.138 |
| −2.792 | −0.464 | 0.138 |
| −2.809 | −0.455 | 0.138 |
| −2.822 | −0.440 | 0.138 |
| −2.829 | −0.421 | 0.138 |
| −2.396 | −0.325 | 0.138 |
| −2.829 | −0.400 | 0.138 |
| −2.819 | −0.358 | 0.138 |
| −2.212 | −0.245 | 0.138 |
| −2.772 | −0.468 | 0.138 |
| 1.156 | −0.410 | 0.138 |
| 0.962 | −0.332 | 0.138 |
| 0.790 | −0.269 | 0.138 |
| 0.615 | −0.211 | 0.138 |
| 1.536 | −0.584 | 0.138 |
| 1.347 | −0.494 | 0.138 |
| 1.928 | −0.299 | 0.138 |
| 1.904 | −0.781 | 0.138 |
| 1.721 | −0.680 | 0.138 |
| 2.151 | −0.488 | 0.138 |
| 2.436 | −1.111 | 0.138 |
| 2.261 | −0.997 | 0.138 |
| 2.084 | −0.886 | 0.138 |
| 2.369 | −0.681 | 0.138 |
| 2.586 | −0.876 | 0.138 |
| 2.608 | −1.229 | 0.138 |
| 3.004 | −1.518 | 0.138 |
| 2.988 | −1.506 | 0.138 |
| 3.068 | −1.321 | 0.138 |
| 3.084 | −1.336 | 0.138 |
| 3.100 | −1.351 | 0.138 |
| 3.116 | −1.366 | 0.138 |
| 3.132 | −1.381 | 0.138 |
| 2.946 | −1.474 | 0.138 |
| 3.147 | −1.399 | 0.138 |
| 2.904 | −1.443 | 0.138 |
| 2.862 | −1.412 | 0.138 |
| 2.736 | −1.320 | 0.138 |
| 3.156 | −1.417 | 0.138 |
| 3.161 | −1.436 | 0.138 |
| 3.161 | −1.455 | 0.138 |
| 3.158 | −1.475 | 0.138 |
| 3.151 | −1.493 | 0.138 |
| 3.052 | −1.306 | 0.138 |
| 2.908 | −1.172 | 0.138 |
| 3.140 | −1.509 | 0.138 |
| 3.124 | −1.524 | 0.138 |
| 3.105 | −1.535 | 0.138 |
| 3.084 | −1.541 | 0.138 |
| 3.062 | −1.542 | 0.138 |
| 3.040 | −1.538 | 0.138 |
| 3.021 | −1.529 | 0.138 |
| −2.730 | −0.243 | 0.241 |
| −2.739 | −0.233 | 0.241 |
| −2.316 | 0.336 | 0.241 |
| −2.242 | 0.393 | 0.241 |
| −2.165 | 0.448 | 0.241 |
| −2.087 | 0.501 | 0.241 |
| −2.746 | −0.222 | 0.241 |
| −2.599 | −0.215 | 0.241 |
| −2.088 | 0.050 | 0.241 |
| −2.193 | 0.003 | 0.241 |
| −2.750 | −0.209 | 0.241 |
| −2.751 | −0.188 | 0.241 |
| −2.747 | −0.167 | 0.241 |
| −2.297 | −0.047 | 0.241 |

TABLE I-continued

| X | Y | Z' |
|---|---|---|
| −2.398 | −0.102 | 0.241 |
| −2.741 | −0.147 | 0.241 |
| −2.734 | −0.127 | 0.241 |
| −2.724 | −0.108 | 0.241 |
| −2.499 | −0.158 | 0.241 |
| −2.702 | −0.069 | 0.241 |
| −2.650 | 0.005 | 0.241 |
| −1.877 | 0.126 | 0.241 |
| −1.980 | 0.091 | 0.241 |
| −1.984 | 0.563 | 0.241 |
| −1.879 | 0.620 | 0.241 |
| −1.771 | 0.673 | 0.241 |
| −1.661 | 0.720 | 0.241 |
| −1.548 | 0.762 | 0.241 |
| −1.434 | 0.798 | 0.241 |
| −1.453 | 0.216 | 0.241 |
| −1.560 | 0.201 | 0.241 |
| −0.682 | 0.189 | 0.241 |
| 0.080 | 0.722 | 0.241 |
| 0.208 | 0.671 | 0.241 |
| −0.181 | 0.805 | 0.241 |
| −0.809 | 0.208 | 0.241 |
| −0.938 | 0.222 | 0.241 |
| −1.066 | 0.230 | 0.241 |
| −1.195 | 0.232 | 0.241 |
| −1.324 | 0.227 | 0.241 |
| −1.200 | 0.852 | 0.241 |
| −1.076 | 0.870 | 0.241 |
| −0.951 | 0.882 | 0.241 |
| −0.825 | 0.887 | 0.241 |
| −0.700 | 0.885 | 0.241 |
| −0.574 | 0.876 | 0.241 |
| −0.449 | 0.860 | 0.241 |
| −0.314 | 0.836 | 0.241 |
| −2.590 | 0.078 | 0.241 |
| 0.077 | −0.025 | 0.241 |
| −2.622 | −0.227 | 0.241 |
| −2.677 | −0.031 | 0.241 |
| −0.093 | 0.036 | 0.241 |
| −2.645 | −0.238 | 0.241 |
| −0.238 | 0.083 | 0.241 |
| −1.667 | 0.181 | 0.241 |
| −2.576 | −0.202 | 0.241 |
| −1.773 | 0.156 | 0.241 |
| −0.050 | 0.766 | 0.241 |
| −2.669 | −0.247 | 0.241 |
| −2.694 | −0.252 | 0.241 |
| −2.526 | 0.146 | 0.241 |
| −2.458 | 0.212 | 0.241 |
| −2.388 | 0.275 | 0.241 |
| −1.318 | 0.828 | 0.241 |
| −0.385 | 0.124 | 0.241 |
| −2.707 | −0.252 | 0.241 |
| −0.532 | 0.159 | 0.241 |
| −2.720 | −0.249 | 0.241 |
| 1.820 | −0.474 | 0.241 |
| 0.968 | 0.237 | 0.241 |
| 1.090 | 0.148 | 0.241 |
| 0.333 | 0.615 | 0.241 |
| 1.751 | −0.901 | 0.241 |
| 1.542 | −0.769 | 0.241 |
| 1.331 | −0.642 | 0.241 |
| 1.241 | 0.030 | 0.241 |
| 1.390 | −0.092 | 0.241 |
| 0.456 | 0.554 | 0.241 |
| 1.117 | −0.519 | 0.241 |
| 0.900 | −0.401 | 0.241 |
| 0.739 | −0.319 | 0.241 |
| 0.576 | −0.239 | 0.241 |
| 0.412 | −0.163 | 0.241 |
| 1.535 | −0.217 | 0.241 |
| 1.679 | −0.344 | 0.241 |
| 0.588 | 0.482 | 0.241 |
| 0.246 | −0.092 | 0.241 |
| 2.747 | −1.613 | 0.241 |
| 2.964 | −1.598 | 0.241 |
| 2.706 | −1.581 | 0.241 |

TABLE I-continued

| X | Y | Z' |
|---|---|---|
| 2.938 | −1.567 | 0.241 |
| 2.584 | −1.486 | 0.241 |
| 2.952 | −1.582 | 0.241 |
| 2.461 | −1.393 | 0.241 |
| 2.295 | −1.272 | 0.241 |
| 2.862 | −1.491 | 0.241 |
| 2.127 | −1.153 | 0.241 |
| 1.957 | −1.037 | 0.241 |
| 2.974 | −1.644 | 0.241 |
| 2.438 | −1.067 | 0.241 |
| 2.029 | −0.669 | 0.241 |
| 2.742 | −1.369 | 0.241 |
| 2.892 | −1.521 | 0.241 |
| 2.936 | −1.702 | 0.241 |
| 2.968 | −1.667 | 0.241 |
| 2.914 | −1.710 | 0.241 |
| 2.955 | −1.687 | 0.241 |
| 0.718 | 0.405 | 0.241 |
| 2.907 | −1.537 | 0.241 |
| 2.922 | −1.552 | 0.241 |
| 2.974 | −1.628 | 0.241 |
| 2.890 | −1.712 | 0.241 |
| 2.868 | −1.706 | 0.241 |
| 2.847 | −1.693 | 0.241 |
| 2.971 | −1.612 | 0.241 |
| 2.827 | −1.676 | 0.241 |
| 2.235 | −0.867 | 0.241 |
| 2.787 | −1.644 | 0.241 |
| 0.844 | 0.323 | 0.241 |
| −2.631 | −0.002 | 0.345 |
| −2.642 | 0.014 | 0.345 |
| −2.648 | 0.033 | 0.345 |
| −2.647 | 0.053 | 0.345 |
| −2.257 | 0.180 | 0.345 |
| −2.340 | 0.130 | 0.345 |
| −2.643 | 0.073 | 0.345 |
| −2.636 | 0.092 | 0.345 |
| −2.628 | 0.111 | 0.345 |
| −2.619 | 0.130 | 0.345 |
| −2.422 | 0.078 | 0.345 |
| −2.504 | 0.026 | 0.345 |
| −2.596 | 0.167 | 0.345 |
| −2.571 | 0.203 | 0.345 |
| −2.545 | 0.238 | 0.345 |
| −2.526 | 0.013 | 0.345 |
| −2.548 | 0.001 | 0.345 |
| −2.493 | 0.299 | 0.345 |
| −2.437 | 0.357 | 0.345 |
| −2.378 | 0.412 | 0.345 |
| −2.571 | −0.009 | 0.345 |
| −2.596 | −0.013 | 0.345 |
| −2.482 | 0.039 | 0.345 |
| −2.084 | 0.268 | 0.345 |
| −2.318 | 0.465 | 0.345 |
| −2.238 | 0.529 | 0.345 |
| −2.155 | 0.589 | 0.345 |
| −2.069 | 0.645 | 0.345 |
| −2.609 | −0.013 | 0.345 |
| −2.621 | −0.009 | 0.345 |
| −2.172 | 0.226 | 0.345 |
| −1.878 | 0.751 | 0.345 |
| −1.773 | 0.800 | 0.345 |
| −1.665 | 0.843 | 0.345 |
| −1.554 | 0.880 | 0.345 |
| −1.382 | 0.436 | 0.345 |
| −1.488 | 0.429 | 0.345 |
| −1.442 | 0.911 | 0.345 |
| −1.594 | 0.415 | 0.345 |
| −1.699 | 0.396 | 0.345 |
| −1.981 | 0.697 | 0.345 |
| −1.802 | 0.370 | 0.345 |
| −1.904 | 0.339 | 0.345 |
| −1.995 | 0.306 | 0.345 |
| −1.273 | 0.437 | 0.345 |
| 0.231 | −0.068 | 0.345 |
| 0.076 | 0.018 | 0.345 |
| −0.082 | 0.101 | 0.345 |

TABLE I-continued

| X | Y | Z' |
|---|---|---|
| −1.329 | 0.936 | 0.345 |
| −1.214 | 0.954 | 0.345 |
| −1.098 | 0.965 | 0.345 |
| −0.217 | 0.166 | 0.345 |
| −0.353 | 0.226 | 0.345 |
| −0.492 | 0.280 | 0.345 |
| −0.976 | 0.970 | 0.345 |
| −0.855 | 0.967 | 0.345 |
| −0.733 | 0.957 | 0.345 |
| −0.612 | 0.940 | 0.345 |
| −0.633 | 0.328 | 0.345 |
| −0.738 | 0.359 | 0.345 |
| −0.843 | 0.385 | 0.345 |
| −0.493 | 0.915 | 0.345 |
| −0.375 | 0.884 | 0.345 |
| −0.249 | 0.844 | 0.345 |
| −0.124 | 0.796 | 0.345 |
| −0.003 | 0.743 | 0.345 |
| −0.949 | 0.406 | 0.345 |
| −1.057 | 0.422 | 0.345 |
| −1.165 | 0.433 | 0.345 |
| 0.116 | 0.684 | 0.345 |
| 0.233 | 0.620 | 0.345 |
| 0.686 | −0.347 | 0.345 |
| 0.536 | −0.251 | 0.345 |
| 0.754 | 0.263 | 0.345 |
| 0.384 | −0.159 | 0.345 |
| 0.896 | 0.148 | 0.345 |
| 1.035 | 0.029 | 0.345 |
| 1.711 | −0.610 | 0.345 |
| 1.208 | −0.126 | 0.345 |
| 1.545 | −0.446 | 0.345 |
| 1.584 | −0.957 | 0.345 |
| 1.378 | −0.285 | 0.345 |
| 1.336 | −0.783 | 0.345 |
| 1.086 | −0.612 | 0.345 |
| 0.834 | −0.444 | 0.345 |
| 0.347 | 0.551 | 0.345 |
| 0.459 | 0.479 | 0.345 |
| 0.608 | 0.374 | 0.345 |
| 2.002 | −0.906 | 0.345 |
| 2.145 | −1.054 | 0.345 |
| 2.770 | −1.814 | 0.345 |
| 2.580 | −1.732 | 0.345 |
| 2.541 | −1.699 | 0.345 |
| 1.857 | −0.757 | 0.345 |
| 2.438 | −1.364 | 0.345 |
| 2.289 | −1.206 | 0.345 |
| 2.753 | −1.826 | 0.345 |
| 2.782 | −1.797 | 0.345 |
| 2.426 | −1.601 | 0.345 |
| 2.771 | −1.722 | 0.345 |
| 2.309 | −1.504 | 0.345 |
| 2.573 | −1.509 | 0.345 |
| 2.714 | −1.661 | 0.345 |
| 2.788 | −1.755 | 0.345 |
| 2.733 | −1.833 | 0.345 |
| 2.712 | −1.833 | 0.345 |
| 2.151 | −1.379 | 0.345 |
| 1.991 | −1.256 | 0.345 |
| 2.742 | −1.692 | 0.345 |
| 2.781 | −1.736 | 0.345 |
| 2.692 | −1.827 | 0.345 |
| 2.788 | −1.777 | 0.345 |
| 2.674 | −1.814 | 0.345 |
| 1.829 | −1.135 | 0.345 |
| 2.701 | −1.646 | 0.345 |
| 2.757 | −1.707 | 0.345 |
| 2.728 | −1.676 | 0.345 |
| 2.656 | −1.798 | 0.345 |
| 2.618 | −1.764 | 0.345 |
| 2.673 | −1.615 | 0.345 |
| −2.050 | 0.733 | 0.448 |
| −2.521 | 0.288 | 0.448 |
| −2.334 | 0.531 | 0.448 |
| −2.124 | 0.687 | 0.448 |
| −2.517 | 0.307 | 0.448 |

TABLE I-continued

| X | Y | Z' |
|---|---|---|
| −2.510 | 0.326 | 0.448 |
| −2.518 | 0.270 | 0.448 |
| −2.096 | 0.403 | 0.448 |
| −2.501 | 0.343 | 0.448 |
| −2.170 | 0.366 | 0.448 |
| −2.491 | 0.360 | 0.448 |
| −2.242 | 0.326 | 0.448 |
| −2.314 | 0.285 | 0.448 |
| −2.386 | 0.247 | 0.448 |
| −2.405 | 0.239 | 0.448 |
| −2.480 | 0.376 | 0.448 |
| −2.423 | 0.233 | 0.448 |
| −2.441 | 0.425 | 0.448 |
| −2.442 | 0.228 | 0.448 |
| −2.267 | 0.586 | 0.448 |
| −2.462 | 0.228 | 0.448 |
| −2.480 | 0.232 | 0.448 |
| −2.497 | 0.241 | 0.448 |
| −2.509 | 0.254 | 0.448 |
| −2.398 | 0.471 | 0.448 |
| −2.197 | 0.638 | 0.448 |
| −1.974 | 0.775 | 0.448 |
| −1.896 | 0.814 | 0.448 |
| −1.816 | 0.850 | 0.448 |
| −1.712 | 0.891 | 0.448 |
| −1.378 | 0.579 | 0.448 |
| −1.481 | 0.572 | 0.448 |
| −1.607 | 0.926 | 0.448 |
| −1.500 | 0.956 | 0.448 |
| −1.391 | 0.980 | 0.448 |
| −1.584 | 0.560 | 0.448 |
| −1.686 | 0.542 | 0.448 |
| −1.787 | 0.517 | 0.448 |
| −1.866 | 0.494 | 0.448 |
| −1.944 | 0.467 | 0.448 |
| −2.021 | 0.436 | 0.448 |
| −1.063 | 0.563 | 0.448 |
| −1.168 | 0.574 | 0.448 |
| −1.274 | 0.579 | 0.448 |
| −1.281 | 0.998 | 0.448 |
| −1.171 | 1.010 | 0.448 |
| −0.949 | 1.015 | 0.448 |
| −0.833 | 1.007 | 0.448 |
| −0.717 | 0.992 | 0.448 |
| −0.603 | 0.971 | 0.448 |
| −0.490 | 0.942 | 0.448 |
| −0.378 | 0.908 | 0.448 |
| 0.112 | 0.079 | 0.448 |
| −0.269 | 0.867 | 0.448 |
| −0.034 | 0.171 | 0.448 |
| −0.153 | 0.816 | 0.448 |
| −0.039 | 0.760 | 0.448 |
| −0.160 | 0.244 | 0.448 |
| −0.288 | 0.312 | 0.448 |
| 0.072 | 0.698 | 0.448 |
| −0.420 | 0.374 | 0.448 |
| 0.180 | 0.631 | 0.448 |
| −0.554 | 0.430 | 0.448 |
| −0.653 | 0.466 | 0.448 |
| −0.754 | 0.497 | 0.448 |
| −1.060 | 1.016 | 0.448 |
| −0.856 | 0.524 | 0.448 |
| −0.959 | 0.546 | 0.448 |
| 0.882 | 0.060 | 0.448 |
| 1.755 | −0.855 | 0.448 |
| 1.007 | −0.062 | 0.448 |
| 1.419 | −0.488 | 0.448 |
| 1.520 | −0.596 | 0.448 |
| 1.216 | −0.273 | 0.448 |
| 1.715 | −1.186 | 0.448 |
| 1.414 | −0.933 | 0.448 |
| 1.112 | −0.682 | 0.448 |
| 0.807 | −0.434 | 0.448 |
| 0.672 | −0.327 | 0.448 |
| 0.535 | −0.221 | 0.448 |
| 0.396 | −0.118 | 0.448 |
| 0.256 | −0.017 | 0.448 |

TABLE I-continued

| X | Y | Z' |
|---|---|---|
| 1.318 | −0.380 | 0.448 |
| 1.259 | −0.804 | 0.448 |
| 0.957 | −0.555 | 0.448 |
| 0.286 | 0.560 | 0.448 |
| 0.389 | 0.485 | 0.448 |
| 0.489 | 0.407 | 0.448 |
| 0.623 | 0.295 | 0.448 |
| 1.620 | −0.706 | 0.448 |
| 1.567 | −1.061 | 0.448 |
| 0.754 | 0.180 | 0.448 |
| 2.575 | −1.899 | 0.448 |
| 1.829 | −1.282 | 0.448 |
| 2.557 | −1.905 | 0.448 |
| 2.538 | −1.904 | 0.448 |
| 2.521 | −1.898 | 0.448 |
| 2.286 | −1.456 | 0.448 |
| 2.504 | −1.886 | 0.448 |
| 2.601 | −1.874 | 0.448 |
| 2.487 | −1.869 | 0.448 |
| 2.434 | −1.818 | 0.448 |
| 2.380 | −1.768 | 0.448 |
| 2.271 | −1.668 | 0.448 |
| 2.162 | −1.570 | 0.448 |
| 1.939 | −1.377 | 0.448 |
| 2.593 | −1.806 | 0.448 |
| 2.581 | −1.792 | 0.448 |
| 2.016 | −1.148 | 0.448 |
| 2.608 | −1.837 | 0.448 |
| 2.043 | −1.466 | 0.448 |
| 2.602 | −1.819 | 0.448 |
| 2.554 | −1.762 | 0.448 |
| 2.149 | −1.299 | 0.448 |
| 1.886 | −1.001 | 0.448 |
| 2.607 | −1.856 | 0.448 |
| 2.567 | −1.777 | 0.448 |
| 2.541 | −1.747 | 0.448 |
| 2.410 | −1.597 | 0.448 |
| 2.590 | −1.889 | 0.448 |
| −2.367 | 0.513 | 0.552 |
| −2.371 | 0.526 | 0.552 |
| −2.370 | 0.540 | 0.552 |
| −2.207 | 0.472 | 0.552 |
| −2.364 | 0.556 | 0.552 |
| −2.354 | 0.572 | 0.552 |
| −2.344 | 0.586 | 0.552 |
| −2.332 | 0.599 | 0.552 |
| −2.256 | 0.457 | 0.552 |
| −2.280 | 0.453 | 0.552 |
| −1.832 | 0.614 | 0.552 |
| −2.299 | 0.633 | 0.552 |
| −2.263 | 0.664 | 0.552 |
| −2.226 | 0.693 | 0.552 |
| −2.148 | 0.747 | 0.552 |
| −2.303 | 0.454 | 0.552 |
| −2.319 | 0.457 | 0.552 |
| −1.922 | 0.586 | 0.552 |
| −1.970 | 0.569 | 0.552 |
| −2.066 | 0.795 | 0.552 |
| −1.981 | 0.839 | 0.552 |
| −1.895 | 0.878 | 0.552 |
| −1.807 | 0.914 | 0.552 |
| −2.333 | 0.465 | 0.552 |
| −2.345 | 0.475 | 0.552 |
| −2.018 | 0.551 | 0.552 |
| −2.066 | 0.532 | 0.552 |
| −2.354 | 0.487 | 0.552 |
| −2.361 | 0.499 | 0.552 |
| −2.113 | 0.512 | 0.552 |
| −2.160 | 0.492 | 0.552 |
| −1.650 | 0.656 | 0.552 |
| −1.742 | 0.637 | 0.552 |
| −1.149 | 1.046 | 0.552 |
| −1.269 | 1.038 | 0.552 |
| −1.149 | 0.679 | 0.552 |
| −1.249 | 0.685 | 0.552 |
| −1.717 | 0.945 | 0.552 |
| −1.626 | 0.972 | 0.552 |

TABLE I-continued

| X | Y | Z' |
|---|---|---|
| −1.508 | 1.001 | 0.552 |
| −1.350 | 0.686 | 0.552 |
| −1.450 | 0.681 | 0.552 |
| −1.550 | 0.671 | 0.552 |
| −1.389 | 1.023 | 0.552 |
| −0.678 | 1.008 | 0.552 |
| −0.570 | 0.983 | 0.552 |
| 0.034 | 0.230 | 0.552 |
| −0.463 | 0.952 | 0.552 |
| −0.084 | 0.306 | 0.552 |
| −0.206 | 0.377 | 0.552 |
| −0.330 | 0.443 | 0.552 |
| −0.458 | 0.502 | 0.552 |
| −0.569 | 0.546 | 0.552 |
| 0.155 | 0.640 | 0.552 |
| −0.682 | 0.585 | 0.552 |
| 0.055 | 0.707 | 0.552 |
| −0.796 | 0.618 | 0.552 |
| −0.913 | 0.645 | 0.552 |
| −0.907 | 1.041 | 0.552 |
| −0.049 | 0.769 | 0.552 |
| −1.030 | 0.665 | 0.552 |
| −0.358 | 0.915 | 0.552 |
| −1.028 | 1.047 | 0.552 |
| −0.787 | 1.027 | 0.552 |
| −0.156 | 0.826 | 0.552 |
| −0.256 | 0.873 | 0.552 |
| 0.171 | 0.133 | 0.552 |
| 0.771 | 0.104 | 0.552 |
| 0.653 | 0.222 | 0.552 |
| 1.311 | −0.912 | 0.552 |
| 0.886 | −0.016 | 0.552 |
| 0.532 | 0.336 | 0.552 |
| 0.442 | 0.416 | 0.552 |
| 0.349 | 0.494 | 0.552 |
| 1.213 | −0.814 | 0.552 |
| 1.110 | −0.711 | 0.552 |
| 1.010 | −0.612 | 0.552 |
| 0.253 | 0.569 | 0.552 |
| 0.806 | −0.413 | 0.552 |
| 0.684 | −0.298 | 0.552 |
| 0.998 | −0.139 | 0.552 |
| 0.560 | −0.185 | 0.552 |
| 0.434 | −0.075 | 0.552 |
| 1.184 | −0.352 | 0.552 |
| 1.366 | −0.567 | 0.552 |
| 0.304 | 0.031 | 0.552 |
| 2.436 | −1.917 | 0.552 |
| 2.377 | −1.813 | 0.552 |
| 1.518 | −1.119 | 0.552 |
| 2.024 | −1.618 | 0.552 |
| 2.258 | −1.666 | 0.552 |
| 1.820 | −1.418 | 0.552 |
| 2.413 | −1.857 | 0.552 |
| 1.617 | −1.217 | 0.552 |
| 2.321 | −1.743 | 0.552 |
| 2.419 | −1.947 | 0.552 |
| 1.906 | −1.230 | 0.552 |
| 1.414 | −1.016 | 0.552 |
| 2.437 | −1.900 | 0.552 |
| 1.923 | −1.519 | 0.552 |
| 2.309 | −1.906 | 0.552 |
| 1.545 | −0.785 | 0.552 |
| 1.717 | −1.316 | 0.552 |
| 2.401 | −1.843 | 0.552 |
| 2.134 | −1.513 | 0.552 |
| 2.425 | −1.871 | 0.552 |
| 2.405 | −1.956 | 0.552 |
| 1.784 | −1.078 | 0.552 |
| 2.388 | −1.960 | 0.552 |
| 2.021 | −1.373 | 0.552 |
| 2.370 | −1.959 | 0.552 |
| 2.355 | −1.953 | 0.552 |
| 2.389 | −1.828 | 0.552 |
| 2.341 | −1.941 | 0.552 |
| 2.433 | −1.884 | 0.552 |
| 1.661 | −0.927 | 0.552 |

TABLE I-continued

| X | Y | Z' |
|---|---|---|
| 2.325 | −1.924 | 0.552 |
| 2.225 | −1.821 | 0.552 |
| 2.125 | −1.719 | 0.552 |
| 2.430 | −1.934 | 0.552 |
| −2.204 | 0.800 | 0.655 |
| −2.193 | 0.813 | 0.655 |
| −2.162 | 0.693 | 0.655 |
| −2.176 | 0.699 | 0.655 |
| −2.181 | 0.826 | 0.655 |
| −2.169 | 0.837 | 0.655 |
| −2.188 | 0.708 | 0.655 |
| −2.198 | 0.720 | 0.655 |
| −2.134 | 0.865 | 0.655 |
| −2.096 | 0.891 | 0.655 |
| −2.204 | 0.732 | 0.655 |
| −1.780 | 0.778 | 0.655 |
| −1.828 | 0.767 | 0.655 |
| −1.876 | 0.755 | 0.655 |
| −2.058 | 0.914 | 0.655 |
| −1.977 | 0.956 | 0.655 |
| −2.209 | 0.745 | 0.655 |
| −2.213 | 0.759 | 0.655 |
| −1.924 | 0.742 | 0.655 |
| −1.972 | 0.728 | 0.655 |
| −2.019 | 0.714 | 0.655 |
| −1.893 | 0.991 | 0.655 |
| −1.808 | 1.022 | 0.655 |
| −2.215 | 0.772 | 0.655 |
| −2.212 | 0.785 | 0.655 |
| −2.067 | 0.700 | 0.655 |
| −2.116 | 0.691 | 0.655 |
| −2.139 | 0.690 | 0.655 |
| −1.721 | 1.049 | 0.655 |
| −1.633 | 1.072 | 0.655 |
| −1.145 | 0.809 | 0.655 |
| −1.267 | 0.819 | 0.655 |
| −1.544 | 1.090 | 0.655 |
| −1.454 | 1.104 | 0.655 |
| −1.389 | 0.822 | 0.655 |
| −1.510 | 0.817 | 0.655 |
| −1.601 | 0.808 | 0.655 |
| −1.339 | 1.116 | 0.655 |
| −1.223 | 1.122 | 0.655 |
| −1.107 | 1.121 | 0.655 |
| −1.691 | 0.795 | 0.655 |
| −0.549 | 1.020 | 0.655 |
| −0.352 | 0.942 | 0.655 |
| −0.256 | 0.895 | 0.655 |
| −1.025 | 0.791 | 0.655 |
| −0.163 | 0.844 | 0.655 |
| −0.073 | 0.789 | 0.655 |
| 0.039 | 0.713 | 0.655 |
| 0.147 | 0.632 | 0.655 |
| 0.206 | 0.157 | 0.655 |
| 0.081 | 0.261 | 0.655 |
| −0.027 | 0.343 | 0.655 |
| −0.139 | 0.422 | 0.655 |
| −0.254 | 0.495 | 0.655 |
| −0.372 | 0.562 | 0.655 |
| −0.476 | 0.614 | 0.655 |
| −0.992 | 1.114 | 0.655 |
| −0.582 | 0.661 | 0.655 |
| −0.877 | 1.099 | 0.655 |
| −0.450 | 0.983 | 0.655 |
| −0.690 | 0.702 | 0.655 |
| −0.800 | 0.738 | 0.655 |
| −0.763 | 1.079 | 0.655 |
| −0.912 | 0.768 | 0.655 |
| −0.651 | 1.051 | 0.655 |
| 1.148 | −0.831 | 0.655 |
| 0.965 | −0.623 | 0.655 |
| 0.781 | −0.417 | 0.655 |
| 0.671 | −0.297 | 0.655 |
| 1.206 | −0.527 | 0.655 |
| 0.559 | −0.179 | 0.655 |
| 0.445 | −0.064 | 0.655 |
| 0.327 | 0.048 | 0.655 |

TABLE I-continued

| X | Y | Z' |
|---|---|---|
| 0.251 | 0.546 | 0.655 |
| 0.352 | 0.456 | 0.655 |
| 0.449 | 0.362 | 0.655 |
| 0.544 | 0.266 | 0.655 |
| 0.684 | 0.114 | 0.655 |
| 0.819 | −0.043 | 0.655 |
| 1.231 | −0.927 | 0.655 |
| 0.951 | −0.202 | 0.655 |
| 1.061 | −0.732 | 0.655 |
| 0.869 | −0.514 | 0.655 |
| 1.079 | −0.364 | 0.655 |
| 1.331 | −0.692 | 0.655 |
| 1.330 | −1.039 | 0.655 |
| 1.790 | −1.558 | 0.655 |
| 2.235 | −1.911 | 0.655 |
| 2.208 | −1.875 | 0.655 |
| 1.776 | −1.288 | 0.655 |
| 2.101 | −1.729 | 0.655 |
| 2.221 | −1.893 | 0.655 |
| 1.997 | −1.588 | 0.655 |
| 2.025 | −1.828 | 0.655 |
| 1.887 | −1.438 | 0.655 |
| 1.672 | −1.147 | 0.655 |
| 2.258 | −1.945 | 0.655 |
| 2.226 | −2.015 | 0.655 |
| 2.209 | −2.018 | 0.655 |
| 2.192 | −2.016 | 0.655 |
| 2.252 | −1.994 | 0.655 |
| 2.241 | −2.007 | 0.655 |
| 1.564 | −1.002 | 0.655 |
| 2.262 | −1.961 | 0.655 |
| 2.177 | −2.008 | 0.655 |
| 2.249 | −1.929 | 0.655 |
| 2.164 | −1.995 | 0.655 |
| 2.150 | −1.978 | 0.655 |
| 2.136 | −1.960 | 0.655 |
| 1.456 | −0.857 | 0.655 |
| 1.429 | −1.152 | 0.655 |
| 2.061 | −1.871 | 0.655 |
| 1.971 | −1.765 | 0.655 |
| 2.260 | −1.979 | 0.655 |
| 1.881 | −1.661 | 0.655 |
| 1.697 | −1.454 | 0.655 |
| 1.605 | −1.350 | 0.655 |
| 2.156 | −1.803 | 0.655 |
| 2.097 | −1.914 | 0.655 |
| 1.514 | −1.247 | 0.655 |
| −1.916 | 0.947 | 0.759 |
| −2.046 | 1.015 | 0.759 |
| −2.046 | 1.028 | 0.759 |
| −1.800 | 1.176 | 0.759 |
| −1.716 | 1.201 | 0.759 |
| −1.369 | 1.001 | 0.759 |
| 0.075 | 0.668 | 0.759 |
| 0.169 | 0.580 | 0.759 |
| −0.800 | 0.878 | 0.759 |
| −1.544 | 1.001 | 0.759 |
| −1.456 | 1.003 | 0.759 |
| −1.963 | 0.941 | 0.759 |
| −1.631 | 1.220 | 0.759 |
| −1.986 | 0.941 | 0.759 |
| −1.545 | 1.234 | 0.759 |
| −2.042 | 1.040 | 0.759 |
| −1.632 | 0.995 | 0.759 |
| −2.032 | 1.053 | 0.759 |
| −1.459 | 1.243 | 0.759 |
| −1.372 | 1.248 | 0.759 |
| −1.775 | 0.975 | 0.759 |
| −1.727 | 0.983 | 0.759 |
| −2.008 | 0.946 | 0.759 |
| −1.285 | 1.249 | 0.759 |
| −2.021 | 0.952 | 0.759 |
| −1.175 | 1.244 | 0.759 |
| −2.020 | 1.064 | 0.759 |
| −2.008 | 1.075 | 0.759 |
| −1.065 | 1.232 | 0.759 |
| −0.956 | 1.214 | 0.759 |

TABLE I-continued

| X | Y | Z' |
|---|---|---|
| −1.019 | 0.947 | 0.759 |
| −0.906 | 0.915 | 0.759 |
| −0.596 | 0.788 | 0.759 |
| −1.869 | 0.957 | 0.759 |
| −2.031 | 0.962 | 0.759 |
| −0.848 | 1.189 | 0.759 |
| −2.038 | 0.975 | 0.759 |
| −0.742 | 1.158 | 0.759 |
| 0.210 | 0.168 | 0.759 |
| −1.995 | 1.085 | 0.759 |
| 0.099 | 0.279 | 0.759 |
| −1.958 | 1.107 | 0.759 |
| 0.002 | 0.369 | 0.759 |
| −0.637 | 1.121 | 0.759 |
| −0.097 | 0.456 | 0.759 |
| −0.535 | 1.078 | 0.759 |
| −1.135 | 0.973 | 0.759 |
| −1.251 | 0.990 | 0.759 |
| −0.697 | 0.836 | 0.759 |
| −1.822 | 0.966 | 0.759 |
| −1.680 | 0.989 | 0.759 |
| −0.426 | 1.024 | 0.759 |
| −2.042 | 0.988 | 0.759 |
| −0.320 | 0.964 | 0.759 |
| −0.201 | 0.538 | 0.759 |
| −1.920 | 1.128 | 0.759 |
| −0.307 | 0.616 | 0.759 |
| −1.881 | 1.146 | 0.759 |
| −0.401 | 0.677 | 0.759 |
| −0.218 | 0.898 | 0.759 |
| −0.497 | 0.735 | 0.759 |
| −0.119 | 0.827 | 0.759 |
| −2.045 | 1.001 | 0.759 |
| −0.023 | 0.752 | 0.759 |
| 1.925 | −1.951 | 0.759 |
| 1.884 | −1.693 | 0.759 |
| 1.886 | −1.897 | 0.759 |
| 1.807 | −1.789 | 0.759 |
| 1.726 | −1.682 | 0.759 |
| 1.451 | −1.062 | 0.759 |
| 1.059 | −0.843 | 0.759 |
| 0.261 | 0.488 | 0.759 |
| 0.349 | 0.394 | 0.759 |
| 0.435 | 0.298 | 0.759 |
| 1.646 | −1.580 | 0.759 |
| 1.561 | −1.471 | 0.759 |
| 1.394 | −1.262 | 0.759 |
| 1.171 | −0.983 | 0.759 |
| 0.949 | −0.704 | 0.759 |
| 0.725 | −0.425 | 0.759 |
| 1.637 | −1.329 | 0.759 |
| 0.519 | 0.199 | 0.759 |
| 0.664 | 0.020 | 0.759 |
| 0.805 | −0.163 | 0.759 |
| 0.943 | −0.348 | 0.759 |
| 1.078 | −0.534 | 0.759 |
| 1.982 | −1.837 | 0.759 |
| 0.626 | −0.303 | 0.759 |
| 0.526 | −0.182 | 0.759 |
| 0.423 | −0.063 | 0.759 |
| 0.318 | 0.054 | 0.759 |
| 1.212 | −0.722 | 0.759 |
| 1.841 | −1.629 | 0.759 |
| 1.345 | −0.910 | 0.759 |
| 1.543 | −1.194 | 0.759 |
| 1.739 | −1.479 | 0.759 |
| 1.475 | −1.363 | 0.759 |
| 1.933 | −1.765 | 0.759 |
| 1.945 | −1.978 | 0.759 |
| 0.837 | −0.564 | 0.759 |
| 2.030 | −1.908 | 0.759 |
| 2.042 | −1.926 | 0.759 |
| 2.054 | −1.944 | 0.759 |
| 2.066 | −1.962 | 0.759 |
| 2.075 | −1.978 | 0.759 |
| 1.906 | −1.925 | 0.759 |
| 2.054 | −2.041 | 0.759 |

TABLE I-continued

| X | Y | Z' |
|---|---|---|
| 2.039 | −2.048 | 0.759 |
| 1.283 | −1.124 | 0.759 |
| 1.849 | −1.847 | 0.759 |
| 2.021 | −2.050 | 0.759 |
| 2.078 | −1.996 | 0.759 |
| 2.004 | −2.047 | 0.759 |
| 2.075 | −2.013 | 0.759 |
| 1.989 | −2.038 | 0.759 |
| 2.006 | −1.873 | 0.759 |
| 2.067 | −2.029 | 0.759 |
| 1.977 | −2.024 | 0.759 |
| 1.763 | −1.732 | 0.759 |
| 1.964 | −2.006 | 0.759 |
| −1.115 | 1.151 | 0.862 |
| −1.817 | 1.316 | 0.862 |
| −1.606 | 1.394 | 0.862 |
| −1.777 | 1.193 | 0.862 |
| −1.390 | 1.413 | 0.862 |
| −1.798 | 1.195 | 0.862 |
| −1.463 | 1.412 | 0.862 |
| −1.203 | 1.173 | 0.862 |
| −1.286 | 1.190 | 0.862 |
| −1.174 | 1.395 | 0.862 |
| −1.840 | 1.295 | 0.862 |
| −1.677 | 1.378 | 0.862 |
| −1.819 | 1.201 | 0.862 |
| −1.370 | 1.201 | 0.862 |
| −1.245 | 1.405 | 0.862 |
| −1.454 | 1.207 | 0.862 |
| −1.830 | 1.307 | 0.862 |
| −1.848 | 1.265 | 0.862 |
| −1.716 | 1.365 | 0.862 |
| −1.754 | 1.350 | 0.862 |
| −1.831 | 1.209 | 0.862 |
| −1.840 | 1.220 | 0.862 |
| −1.508 | 1.209 | 0.862 |
| −1.562 | 1.208 | 0.862 |
| −1.318 | 1.411 | 0.862 |
| −1.102 | 1.382 | 0.862 |
| −1.845 | 1.233 | 0.862 |
| −1.848 | 1.249 | 0.862 |
| −1.616 | 1.205 | 0.862 |
| −1.670 | 1.201 | 0.862 |
| −1.535 | 1.405 | 0.862 |
| −1.791 | 1.333 | 0.862 |
| −1.805 | 1.325 | 0.862 |
| −1.846 | 1.281 | 0.862 |
| −1.723 | 1.195 | 0.862 |
| −0.253 | 0.644 | 0.862 |
| −0.351 | 0.728 | 0.862 |
| −0.433 | 1.084 | 0.862 |
| −0.340 | 1.016 | 0.862 |
| −0.802 | 1.288 | 0.862 |
| −0.900 | 1.326 | 0.862 |
| −0.453 | 0.808 | 0.862 |
| −0.558 | 0.883 | 0.862 |
| −0.250 | 0.943 | 0.862 |
| −0.163 | 0.867 | 0.862 |
| −0.079 | 0.787 | 0.862 |
| −1.000 | 1.357 | 0.862 |
| −0.667 | 0.952 | 0.862 |
| −0.780 | 1.015 | 0.862 |
| 0.003 | 0.705 | 0.862 |
| 0.103 | 0.596 | 0.862 |
| −0.706 | 1.244 | 0.862 |
| −0.861 | 1.055 | 0.862 |
| 0.200 | 0.485 | 0.862 |
| −0.612 | 1.196 | 0.862 |
| 0.221 | 0.145 | 0.862 |
| 0.103 | 0.283 | 0.862 |
| −0.944 | 1.091 | 0.862 |
| −1.029 | 1.123 | 0.862 |
| 0.018 | 0.377 | 0.862 |
| −0.521 | 1.142 | 0.862 |
| −0.069 | 0.469 | 0.862 |
| −0.160 | 0.558 | 0.862 |
| 0.631 | −0.073 | 0.862 |

TABLE I-continued

| X | Y | Z' |
|---|---|---|
| 1.197 | −1.156 | 0.862 |
| 0.935 | −0.504 | 0.862 |
| 1.274 | −1.259 | 0.862 |
| 1.083 | −0.721 | 0.862 |
| 0.814 | −0.634 | 0.862 |
| 1.230 | −0.939 | 0.862 |
| 0.968 | −0.845 | 0.862 |
| 0.664 | −0.429 | 0.862 |
| 0.784 | −0.288 | 0.862 |
| 0.556 | −0.284 | 0.862 |
| 1.123 | −1.055 | 0.862 |
| 0.447 | −0.139 | 0.862 |
| 1.323 | −1.078 | 0.862 |
| 0.335 | 0.004 | 0.862 |
| 0.294 | 0.371 | 0.862 |
| 1.347 | −1.358 | 0.862 |
| 0.385 | 0.256 | 0.862 |
| 0.475 | 0.139 | 0.862 |
| 1.839 | −1.868 | 0.862 |
| 1.894 | −2.020 | 0.862 |
| 1.757 | −1.942 | 0.862 |
| 1.543 | −1.629 | 0.862 |
| 1.905 | −1.988 | 0.862 |
| 1.453 | −1.275 | 0.862 |
| 1.649 | −1.782 | 0.862 |
| 1.811 | −1.826 | 0.862 |
| 1.731 | −1.703 | 0.862 |
| 1.894 | −1.953 | 0.862 |
| 1.504 | −1.576 | 0.862 |
| 1.883 | −1.937 | 0.862 |
| 1.387 | −1.414 | 0.862 |
| 1.576 | −1.676 | 0.862 |
| 1.685 | −1.835 | 0.862 |
| 1.426 | −1.467 | 0.862 |
| 1.466 | −1.522 | 0.862 |
| 1.496 | −1.341 | 0.862 |
| 1.613 | −1.729 | 0.862 |
| 1.371 | −1.152 | 0.862 |
| 1.640 | −1.562 | 0.862 |
| 1.592 | −1.489 | 0.862 |
| 1.544 | −1.415 | 0.862 |
| 1.412 | −1.213 | 0.862 |
| 1.902 | −2.005 | 0.862 |
| 1.881 | −2.032 | 0.862 |
| 1.903 | −1.970 | 0.862 |
| 1.865 | −2.039 | 0.862 |
| 1.848 | −2.041 | 0.862 |
| 1.872 | −1.920 | 0.862 |
| 1.861 | −1.903 | 0.862 |
| 1.771 | −1.764 | 0.862 |
| 1.831 | −2.036 | 0.862 |
| 1.816 | −2.028 | 0.862 |
| 1.804 | −2.013 | 0.862 |
| 1.793 | −1.995 | 0.862 |
| 1.688 | −1.636 | 0.862 |
| −1.144 | 1.577 | 0.966 |
| −1.219 | 1.595 | 0.966 |
| −1.394 | 1.439 | 0.966 |
| −1.612 | 1.477 | 0.966 |
| −1.621 | 1.488 | 0.966 |
| −1.545 | 1.591 | 0.966 |
| −1.589 | 1.571 | 0.966 |
| −1.605 | 1.560 | 0.966 |
| −1.627 | 1.518 | 0.966 |
| −1.618 | 1.546 | 0.966 |
| −1.242 | 1.403 | 0.966 |
| −1.572 | 1.581 | 0.966 |
| −1.399 | 1.612 | 0.966 |
| −1.624 | 1.533 | 0.966 |
| −1.511 | 1.453 | 0.966 |
| −1.459 | 1.609 | 0.966 |
| −1.584 | 1.465 | 0.966 |
| −1.096 | 1.348 | 0.966 |
| −1.599 | 1.469 | 0.966 |
| −1.278 | 1.605 | 0.966 |
| −1.338 | 1.611 | 0.966 |
| −1.168 | 1.378 | 0.966 |

TABLE I-continued

| X | Y | Z' |
|---|---|---|
| −1.549 | 1.458 | 0.966 |
| −1.471 | 1.449 | 0.966 |
| −1.488 | 1.605 | 0.966 |
| −1.516 | 1.599 | 0.966 |
| −1.317 | 1.423 | 0.966 |
| −1.627 | 1.502 | 0.966 |
| −1.071 | 1.554 | 0.966 |
| −0.564 | 0.986 | 0.966 |
| −1.000 | 1.527 | 0.966 |
| −0.930 | 1.495 | 0.966 |
| −0.841 | 1.449 | 0.966 |
| −0.756 | 1.397 | 0.966 |
| −0.668 | 1.075 | 0.966 |
| −0.674 | 1.340 | 0.966 |
| −0.595 | 1.280 | 0.966 |
| −0.519 | 1.216 | 0.966 |
| −0.445 | 1.148 | 0.966 |
| −0.275 | 0.694 | 0.966 |
| −0.374 | 1.079 | 0.966 |
| −0.266 | 0.966 | 0.966 |
| −1.025 | 1.314 | 0.966 |
| −0.163 | 0.849 | 0.966 |
| −0.063 | 0.730 | 0.966 |
| 0.075 | 0.272 | 0.966 |
| 0.034 | 0.607 | 0.966 |
| 0.129 | 0.483 | 0.966 |
| −0.464 | 0.892 | 0.966 |
| 0.163 | 0.158 | 0.966 |
| 0.222 | 0.358 | 0.966 |
| −0.184 | 0.591 | 0.966 |
| −0.840 | 1.204 | 0.966 |
| −0.096 | 0.486 | 0.966 |
| −0.368 | 0.795 | 0.966 |
| −0.931 | 1.262 | 0.966 |
| −0.010 | 0.380 | 0.966 |
| −0.753 | 1.142 | 0.966 |
| 0.754 | −0.398 | 0.966 |
| 0.719 | −0.611 | 0.966 |
| 1.233 | −1.117 | 0.966 |
| 0.877 | −0.579 | 0.966 |
| 0.647 | −0.509 | 0.966 |
| 1.322 | −1.471 | 0.966 |
| 1.221 | −1.323 | 0.966 |
| 0.792 | −0.713 | 0.966 |
| 1.088 | −1.134 | 0.966 |
| 0.418 | −0.189 | 0.966 |
| 1.290 | −1.423 | 0.966 |
| 1.150 | −1.222 | 0.966 |
| 1.254 | −1.372 | 0.966 |
| 1.199 | −1.064 | 0.966 |
| 0.586 | −0.422 | 0.966 |
| 0.524 | −0.065 | 0.966 |
| 0.314 | 0.232 | 0.966 |
| 0.404 | 0.105 | 0.966 |
| 0.643 | −0.236 | 0.966 |
| 1.323 | −1.255 | 0.966 |
| 0.339 | −0.079 | 0.966 |
| 1.358 | −1.524 | 0.966 |
| 1.278 | −1.186 | 0.966 |
| 0.946 | −0.932 | 0.966 |
| 0.497 | −0.299 | 0.966 |
| 0.999 | −0.761 | 0.966 |
| 1.108 | −0.925 | 0.966 |
| 0.869 | −0.822 | 0.966 |
| 0.249 | 0.043 | 0.966 |
| 1.017 | −1.033 | 0.966 |
| 1.360 | −1.313 | 0.966 |
| 1.403 | −1.380 | 0.966 |
| 1.491 | −1.516 | 0.966 |
| 1.461 | −1.675 | 0.966 |
| 1.394 | −1.576 | 0.966 |
| 1.719 | −1.875 | 0.966 |
| 1.701 | −1.974 | 0.966 |
| 1.643 | −1.754 | 0.966 |
| 1.630 | −1.932 | 0.966 |
| 1.667 | −1.972 | 0.966 |
| 1.699 | −1.842 | 0.966 |

TABLE I-continued

| X | Y | Z' |
|---|---|---|
| 1.596 | −1.881 | 0.966 |
| 1.561 | −1.627 | 0.966 |
| 1.729 | −1.956 | 0.966 |
| 1.427 | −1.626 | 0.966 |
| 1.652 | −1.963 | 0.966 |
| 1.496 | −1.728 | 0.966 |
| 1.683 | −1.976 | 0.966 |
| 1.737 | −1.941 | 0.966 |
| 1.527 | −1.775 | 0.966 |
| 1.741 | −1.924 | 0.966 |
| 1.447 | −1.448 | 0.966 |
| 1.670 | −1.797 | 0.966 |
| 1.615 | −1.711 | 0.966 |
| 1.641 | −1.949 | 0.966 |
| 1.738 | −1.907 | 0.966 |
| 1.730 | −1.891 | 0.966 |
| 1.709 | −1.859 | 0.966 |
| 1.716 | −1.968 | 0.966 |
| 1.587 | −1.667 | 0.966 |
| 1.533 | −1.583 | 0.966 |
| 1.563 | −1.830 | 0.966 |
| −0.711 | 0.762 | 0.069 |
| −0.177 | 0.767 | 0.069 |
| −0.434 | 0.777 | 0.069 |
| −1.624 | 0.522 | 0.069 |
| −1.972 | 0.343 | 0.069 |
| −1.859 | 0.408 | 0.069 |
| −1.742 | 0.468 | 0.069 |
| −1.255 | 0.656 | 0.069 |
| −1.380 | 0.617 | 0.069 |
| −1.503 | 0.572 | 0.069 |
| −2.084 | 0.274 | 0.069 |
| −2.192 | 0.201 | 0.069 |
| −2.297 | 0.123 | 0.069 |
| −2.622 | −0.171 | 0.069 |
| −2.550 | −0.098 | 0.069 |
| −2.475 | −0.028 | 0.069 |
| −2.398 | 0.040 | 0.069 |
| −1.354 | −0.156 | 0.069 |
| −0.985 | 0.722 | 0.069 |
| 0.078 | 0.737 | 0.069 |
| −0.568 | −0.083 | 0.069 |
| −0.723 | −0.087 | 0.069 |
| −0.882 | −0.097 | 0.069 |
| −1.040 | −0.111 | 0.069 |
| −1.197 | −0.131 | 0.069 |
| 0.084 | −0.115 | 0.069 |
| −0.101 | −0.098 | 0.069 |
| −0.256 | −0.088 | 0.069 |
| −0.412 | −0.083 | 0.069 |
| 0.585 | 0.612 | 0.069 |
| 0.709 | 0.569 | 0.069 |
| 0.861 | 0.509 | 0.069 |
| 1.010 | 0.443 | 0.069 |
| 1.157 | 0.371 | 0.069 |
| 0.334 | 0.684 | 0.069 |
| 0.460 | 0.651 | 0.069 |
| 1.301 | 0.294 | 0.069 |
| 0.452 | −0.166 | 0.069 |
| 0.268 | −0.138 | 0.069 |
| 1.445 | 0.210 | 0.069 |
| 1.586 | 0.122 | 0.069 |
| 1.724 | 0.030 | 0.069 |
| 1.861 | −0.066 | 0.069 |
| 1.995 | −0.164 | 0.069 |
| −2.866 | −0.546 | 0.069 |
| −2.706 | −0.591 | 0.069 |
| −2.732 | −0.597 | 0.069 |
| −2.865 | −0.524 | 0.069 |
| −2.860 | −0.503 | 0.069 |
| −2.853 | −0.482 | 0.069 |
| −2.784 | −0.601 | 0.069 |
| −2.844 | −0.462 | 0.069 |
| −2.834 | −0.443 | 0.069 |
| −2.758 | −0.600 | 0.069 |
| −2.756 | −0.327 | 0.069 |
| −2.810 | −0.597 | 0.069 |

TABLE I-continued

| X | Y | Z' |
|---|---|---|
| −2.829 | −0.590 | 0.069 |
| −2.784 | −0.364 | 0.069 |
| −2.692 | −0.247 | 0.069 |
| −1.510 | −0.187 | 0.069 |
| −1.645 | −0.218 | 0.069 |
| −1.780 | −0.254 | 0.069 |
| −2.810 | −0.403 | 0.069 |
| −1.913 | −0.294 | 0.069 |
| −2.846 | −0.580 | 0.069 |
| −2.045 | −0.338 | 0.069 |
| −2.855 | −0.570 | 0.069 |
| −2.191 | −0.391 | 0.069 |
| −2.336 | −0.449 | 0.069 |
| −2.397 | −0.474 | 0.069 |
| −2.458 | −0.500 | 0.069 |
| −2.519 | −0.525 | 0.069 |
| −2.862 | −0.559 | 0.069 |
| −2.581 | −0.550 | 0.069 |
| −2.643 | −0.573 | 0.069 |
| 1.168 | −0.338 | 0.069 |
| 0.994 | −0.287 | 0.069 |
| 0.815 | −0.241 | 0.069 |
| 0.634 | −0.201 | 0.069 |
| 1.842 | −0.595 | 0.069 |
| 1.677 | −0.522 | 0.069 |
| 1.509 | −0.455 | 0.069 |
| 1.339 | −0.394 | 0.069 |
| 2.703 | −1.089 | 0.069 |
| 2.170 | −0.299 | 0.069 |
| 2.343 | −0.437 | 0.069 |
| 2.513 | −0.578 | 0.069 |
| 2.571 | −1.001 | 0.069 |
| 2.682 | −0.721 | 0.069 |
| 2.438 | −0.916 | 0.069 |
| 3.017 | −1.009 | 0.069 |
| 3.101 | −1.081 | 0.069 |
| 2.303 | −0.834 | 0.069 |
| 2.165 | −0.757 | 0.069 |
| 2.005 | −0.673 | 0.069 |
| 3.151 | −1.403 | 0.069 |
| 3.131 | −1.396 | 0.069 |
| 3.114 | −1.386 | 0.069 |
| 3.100 | −1.376 | 0.069 |
| 3.087 | −1.366 | 0.069 |
| 3.045 | −1.335 | 0.069 |
| 3.003 | −1.304 | 0.069 |
| 2.960 | −1.272 | 0.069 |
| 2.832 | −1.180 | 0.069 |
| 3.184 | −1.154 | 0.069 |
| 3.201 | −1.168 | 0.069 |
| 3.265 | −1.365 | 0.069 |
| 3.246 | −1.384 | 0.069 |
| 3.218 | −1.183 | 0.069 |
| 3.235 | −1.197 | 0.069 |
| 3.252 | −1.213 | 0.069 |
| 3.269 | −1.233 | 0.069 |
| 3.281 | −1.254 | 0.069 |
| 3.288 | −1.277 | 0.069 |
| 3.289 | −1.300 | 0.069 |
| 3.224 | −1.397 | 0.069 |
| 3.199 | −1.405 | 0.069 |
| 3.172 | −1.407 | 0.069 |
| 3.286 | −1.323 | 0.069 |
| 3.278 | −1.345 | 0.069 |
| −2.755 | −0.212 | 0.172 |
| −2.730 | −0.175 | 0.172 |
| −2.702 | −0.138 | 0.172 |
| −2.641 | −0.065 | 0.172 |
| −2.122 | −0.127 | 0.172 |
| −2.229 | −0.172 | 0.172 |
| −2.576 | 0.005 | 0.172 |
| −2.507 | 0.072 | 0.172 |
| −2.437 | 0.137 | 0.172 |
| −2.335 | −0.221 | 0.172 |
| −2.440 | −0.271 | 0.172 |
| −2.544 | −0.323 | 0.172 |
| −2.649 | −0.372 | 0.172 |

TABLE I-continued

| X | Y | Z' |
|---|---|---|
| −2.673 | −0.382 | 0.172 |
| −2.698 | −0.391 | 0.172 |
| −2.364 | 0.199 | 0.172 |
| −2.289 | 0.259 | 0.172 |
| −2.723 | −0.397 | 0.172 |
| −2.625 | −0.362 | 0.172 |
| −2.749 | −0.399 | 0.172 |
| −2.768 | −0.397 | 0.172 |
| −2.785 | −0.388 | 0.172 |
| −2.798 | −0.373 | 0.172 |
| −2.805 | −0.354 | 0.172 |
| −2.213 | 0.316 | 0.172 |
| −2.134 | 0.370 | 0.172 |
| −2.806 | −0.333 | 0.172 |
| −2.803 | −0.311 | 0.172 |
| −2.797 | −0.291 | 0.172 |
| −2.788 | −0.271 | 0.172 |
| −2.778 | −0.252 | 0.172 |
| −1.354 | 0.071 | 0.172 |
| −1.483 | 0.052 | 0.172 |
| −1.645 | 0.634 | 0.172 |
| −1.515 | 0.684 | 0.172 |
| −1.383 | 0.728 | 0.172 |
| −1.617 | 0.027 | 0.172 |
| −1.751 | −0.005 | 0.172 |
| −1.883 | −0.042 | 0.172 |
| −2.013 | −0.086 | 0.172 |
| −2.017 | 0.445 | 0.172 |
| −1.896 | 0.514 | 0.172 |
| −1.772 | 0.577 | 0.172 |
| −0.964 | 0.093 | 0.172 |
| −1.094 | 0.091 | 0.172 |
| −1.224 | 0.083 | 0.172 |
| −0.550 | 0.069 | 0.172 |
| −1.249 | 0.764 | 0.172 |
| −1.124 | 0.791 | 0.172 |
| −0.998 | 0.811 | 0.172 |
| 0.081 | −0.053 | 0.172 |
| −0.871 | 0.826 | 0.172 |
| −0.744 | 0.834 | 0.172 |
| −0.616 | 0.835 | 0.172 |
| −0.489 | 0.830 | 0.172 |
| −0.398 | 0.048 | 0.172 |
| −0.833 | 0.090 | 0.172 |
| −0.247 | 0.022 | 0.172 |
| −0.350 | 0.818 | 0.172 |
| −0.096 | −0.010 | 0.172 |
| −0.213 | 0.798 | 0.172 |
| −0.076 | 0.772 | 0.172 |
| −0.703 | 0.083 | 0.172 |
| 0.059 | 0.739 | 0.172 |
| 0.193 | 0.699 | 0.172 |
| 0.775 | −0.285 | 0.172 |
| 1.442 | 0.010 | 0.172 |
| 1.595 | −0.110 | 0.172 |
| 1.745 | −0.234 | 0.172 |
| 0.454 | 0.602 | 0.172 |
| 0.432 | −0.158 | 0.172 |
| 0.257 | −0.103 | 0.172 |
| 0.593 | 0.540 | 0.172 |
| 0.604 | −0.219 | 0.172 |
| 1.285 | 0.126 | 0.172 |
| 0.730 | 0.472 | 0.172 |
| 0.864 | 0.398 | 0.172 |
| 1.504 | −0.628 | 0.172 |
| 0.996 | 0.319 | 0.172 |
| 1.686 | −0.729 | 0.172 |
| 1.320 | −0.532 | 0.172 |
| 1.133 | −0.442 | 0.172 |
| 1.125 | 0.237 | 0.172 |
| 0.943 | −0.356 | 0.172 |
| 0.324 | 0.654 | 0.172 |
| 1.893 | −0.361 | 0.172 |
| 2.325 | −0.748 | 0.172 |
| 2.537 | −0.945 | 0.172 |
| 2.560 | −1.290 | 0.172 |
| 2.390 | −1.171 | 0.172 |

TABLE I-continued

| X | Y | Z' |
|---|---|---|
| 2.217 | −1.055 | 0.172 |
| 1.866 | −0.834 | 0.172 |
| 2.111 | −0.553 | 0.172 |
| 2.042 | −0.943 | 0.172 |
| 2.936 | −1.568 | 0.172 |
| 3.088 | −1.558 | 0.172 |
| 3.094 | −1.488 | 0.172 |
| 2.853 | −1.505 | 0.172 |
| 3.098 | −1.524 | 0.172 |
| 2.951 | −1.580 | 0.172 |
| 2.811 | −1.474 | 0.172 |
| 2.686 | −1.381 | 0.172 |
| 3.095 | −1.542 | 0.172 |
| 3.046 | −1.597 | 0.172 |
| 2.853 | −1.244 | 0.172 |
| 2.994 | −1.388 | 0.172 |
| 3.010 | −1.395 | 0.172 |
| 3.025 | −1.410 | 0.172 |
| 3.041 | −1.425 | 0.172 |
| 3.098 | −1.506 | 0.172 |
| 3.057 | −1.440 | 0.172 |
| 3.063 | −1.587 | 0.172 |
| 3.072 | −1.455 | 0.172 |
| 3.078 | −1.573 | 0.172 |
| 3.026 | −1.603 | 0.172 |
| 3.086 | −1.472 | 0.172 |
| 3.006 | −1.603 | 0.172 |
| 2.986 | −1.600 | 0.172 |
| 2.895 | −1.536 | 0.172 |
| 2.968 | −1.591 | 0.172 |
| −2.592 | −0.147 | 0.276 |
| −2.615 | −0.159 | 0.276 |
| −2.715 | −0.090 | 0.276 |
| −2.709 | −0.069 | 0.276 |
| −2.701 | −0.050 | 0.276 |
| −2.692 | −0.031 | 0.276 |
| −2.670 | 0.008 | 0.276 |
| −2.548 | −0.121 | 0.276 |
| −2.638 | −0.169 | 0.276 |
| −2.663 | −0.174 | 0.276 |
| −2.646 | 0.045 | 0.276 |
| −2.619 | 0.081 | 0.276 |
| −2.567 | 0.145 | 0.276 |
| −2.512 | 0.205 | 0.276 |
| −2.453 | 0.263 | 0.276 |
| −2.067 | 0.138 | 0.276 |
| −2.171 | 0.091 | 0.276 |
| −2.676 | −0.174 | 0.276 |
| −2.393 | 0.319 | 0.276 |
| −2.313 | 0.387 | 0.276 |
| −2.231 | 0.451 | 0.276 |
| −2.145 | 0.512 | 0.276 |
| −2.058 | 0.569 | 0.276 |
| −2.274 | 0.040 | 0.276 |
| −2.374 | −0.016 | 0.276 |
| −2.699 | −0.165 | 0.276 |
| −2.708 | −0.155 | 0.276 |
| −2.714 | −0.144 | 0.276 |
| −2.689 | −0.172 | 0.276 |
| −2.472 | −0.075 | 0.276 |
| −2.570 | −0.134 | 0.276 |
| −2.718 | −0.131 | 0.276 |
| −2.719 | −0.110 | 0.276 |
| −1.647 | 0.266 | 0.276 |
| −1.753 | 0.242 | 0.276 |
| −1.857 | 0.214 | 0.276 |
| −1.960 | 0.180 | 0.276 |
| −1.955 | 0.629 | 0.276 |
| −1.850 | 0.684 | 0.276 |
| −1.742 | 0.734 | 0.276 |
| −1.631 | 0.778 | 0.276 |
| −1.434 | 0.296 | 0.276 |
| −1.519 | 0.816 | 0.276 |
| −1.405 | 0.849 | 0.276 |
| −1.541 | 0.284 | 0.276 |
| −0.799 | 0.915 | 0.276 |
| −0.674 | 0.908 | 0.276 |

TABLE I-continued

| X | Y | Z' |
|---|---|---|
| −0.550 | 0.893 | 0.276 |
| −1.048 | 0.909 | 0.276 |
| 0.074 | −0.012 | 0.276 |
| −0.092 | 0.057 | 0.276 |
| −0.234 | 0.111 | 0.276 |
| −0.428 | 0.872 | 0.276 |
| −0.295 | 0.842 | 0.276 |
| −0.165 | 0.805 | 0.276 |
| −0.923 | 0.916 | 0.276 |
| −0.377 | 0.159 | 0.276 |
| −0.522 | 0.202 | 0.276 |
| −0.669 | 0.239 | 0.276 |
| −0.036 | 0.761 | 0.276 |
| 0.090 | 0.711 | 0.276 |
| 0.214 | 0.655 | 0.276 |
| −0.795 | 0.264 | 0.276 |
| −0.921 | 0.284 | 0.276 |
| −1.049 | 0.297 | 0.276 |
| −1.177 | 0.304 | 0.276 |
| −1.306 | 0.304 | 0.276 |
| −1.289 | 0.875 | 0.276 |
| −1.171 | 0.895 | 0.276 |
| 0.400 | −0.165 | 0.276 |
| 0.238 | −0.087 | 0.276 |
| 1.070 | 0.105 | 0.276 |
| 1.402 | −0.737 | 0.276 |
| 1.218 | −0.015 | 0.276 |
| 1.141 | −0.576 | 0.276 |
| 1.362 | −0.139 | 0.276 |
| 1.504 | −0.265 | 0.276 |
| 0.876 | −0.421 | 0.276 |
| 0.336 | 0.594 | 0.276 |
| 0.455 | 0.529 | 0.276 |
| 0.584 | 0.452 | 0.276 |
| 0.719 | −0.333 | 0.276 |
| 1.644 | −0.394 | 0.276 |
| 1.660 | −0.904 | 0.276 |
| 1.783 | −0.524 | 0.276 |
| 0.709 | 0.371 | 0.276 |
| 0.832 | 0.286 | 0.276 |
| 0.952 | 0.197 | 0.276 |
| 0.560 | −0.248 | 0.276 |
| 2.775 | −1.514 | 0.276 |
| 2.892 | −1.636 | 0.276 |
| 2.692 | −1.659 | 0.276 |
| 2.088 | −0.819 | 0.276 |
| 2.652 | −1.627 | 0.276 |
| 2.912 | −1.695 | 0.276 |
| 2.532 | −1.531 | 0.276 |
| 2.389 | −1.119 | 0.276 |
| 2.411 | −1.436 | 0.276 |
| 2.686 | −1.422 | 0.276 |
| 2.833 | −1.575 | 0.276 |
| 2.612 | −1.594 | 0.276 |
| 2.893 | −1.736 | 0.276 |
| 2.875 | −1.750 | 0.276 |
| 2.848 | −1.590 | 0.276 |
| 2.247 | −1.314 | 0.276 |
| 2.909 | −1.665 | 0.276 |
| 2.854 | −1.758 | 0.276 |
| 2.832 | −1.758 | 0.276 |
| 2.810 | −1.753 | 0.276 |
| 2.863 | −1.606 | 0.276 |
| 2.081 | −1.193 | 0.276 |
| 2.878 | −1.621 | 0.276 |
| 2.906 | −1.717 | 0.276 |
| 2.903 | −1.651 | 0.276 |
| 2.790 | −1.740 | 0.276 |
| 2.771 | −1.723 | 0.276 |
| 2.731 | −1.691 | 0.276 |
| 1.914 | −1.076 | 0.276 |
| 2.804 | −1.544 | 0.276 |
| 2.912 | −1.680 | 0.276 |
| −2.385 | 0.154 | 0.379 |
| −2.467 | 0.103 | 0.379 |
| −2.484 | 0.093 | 0.379 |
| −2.502 | 0.084 | 0.379 |

TABLE I-continued

| X | Y | Z' |
|---|---|---|
| −2.520 | 0.075 | 0.379 |
| −2.540 | 0.070 | 0.379 |
| −2.560 | 0.069 | 0.379 |
| −2.573 | 0.070 | 0.379 |
| −2.584 | 0.075 | 0.379 |
| −2.594 | 0.083 | 0.379 |
| −2.604 | 0.099 | 0.379 |
| −2.609 | 0.117 | 0.379 |
| −2.607 | 0.137 | 0.379 |
| −2.602 | 0.157 | 0.379 |
| −2.088 | 0.664 | 0.379 |
| −2.595 | 0.176 | 0.379 |
| −2.586 | 0.194 | 0.379 |
| −2.576 | 0.212 | 0.379 |
| −2.553 | 0.248 | 0.379 |
| −2.528 | 0.283 | 0.379 |
| −2.501 | 0.316 | 0.379 |
| −2.049 | 0.339 | 0.379 |
| −2.136 | 0.298 | 0.379 |
| −2.440 | 0.383 | 0.379 |
| −2.375 | 0.446 | 0.379 |
| −2.307 | 0.505 | 0.379 |
| −2.237 | 0.561 | 0.379 |
| −2.164 | 0.614 | 0.379 |
| −2.221 | 0.253 | 0.379 |
| −2.304 | 0.205 | 0.379 |
| −2.011 | 0.710 | 0.379 |
| −1.932 | 0.754 | 0.379 |
| −1.829 | 0.804 | 0.379 |
| −1.455 | 0.488 | 0.379 |
| −1.723 | 0.849 | 0.379 |
| −1.560 | 0.477 | 0.379 |
| −1.615 | 0.888 | 0.379 |
| −1.506 | 0.921 | 0.379 |
| −1.394 | 0.948 | 0.379 |
| −1.664 | 0.460 | 0.379 |
| −1.767 | 0.436 | 0.379 |
| −1.869 | 0.407 | 0.379 |
| −1.960 | 0.375 | 0.379 |
| −1.349 | 0.493 | 0.379 |
| −0.336 | 0.257 | 0.379 |
| −1.281 | 0.968 | 0.379 |
| −1.167 | 0.982 | 0.379 |
| −0.472 | 0.315 | 0.379 |
| −0.610 | 0.366 | 0.379 |
| −1.053 | 0.990 | 0.379 |
| −0.933 | 0.990 | 0.379 |
| −0.813 | 0.983 | 0.379 |
| −0.693 | 0.968 | 0.379 |
| −0.575 | 0.947 | 0.379 |
| −0.713 | 0.399 | 0.379 |
| −0.816 | 0.428 | 0.379 |
| 0.234 | −0.054 | 0.379 |
| −0.458 | 0.918 | 0.379 |
| −0.343 | 0.883 | 0.379 |
| −0.220 | 0.839 | 0.379 |
| −0.099 | 0.787 | 0.379 |
| 0.019 | 0.730 | 0.379 |
| −0.921 | 0.452 | 0.379 |
| −1.027 | 0.471 | 0.379 |
| 0.083 | 0.037 | 0.379 |
| −0.071 | 0.124 | 0.379 |
| 0.134 | 0.668 | 0.379 |
| −1.134 | 0.484 | 0.379 |
| −1.242 | 0.491 | 0.379 |
| −0.202 | 0.193 | 0.379 |
| 0.978 | −0.557 | 0.379 |
| 0.750 | 0.234 | 0.379 |
| 0.887 | 0.117 | 0.379 |
| 1.021 | −0.004 | 0.379 |
| 1.789 | −1.156 | 0.379 |
| 1.354 | −0.320 | 0.379 |
| 1.469 | −0.915 | 0.379 |
| 1.189 | −0.160 | 0.379 |
| 1.146 | −0.678 | 0.379 |
| 0.820 | −0.445 | 0.379 |
| 0.675 | −0.345 | 0.379 |

TABLE I-continued

| X | Y | Z' |
|---|---|---|
| 1.305 | −0.794 | 0.379 |
| 1.517 | −0.482 | 0.379 |
| 0.530 | −0.245 | 0.379 |
| 0.383 | −0.148 | 0.379 |
| 1.631 | −1.036 | 0.379 |
| 1.677 | −0.645 | 0.379 |
| 0.247 | 0.601 | 0.379 |
| 0.357 | 0.529 | 0.379 |
| 0.465 | 0.455 | 0.379 |
| 0.609 | 0.347 | 0.379 |
| 2.258 | −1.530 | 0.379 |
| 2.518 | −1.543 | 0.379 |
| 2.104 | −1.403 | 0.379 |
| 2.616 | −1.842 | 0.379 |
| 2.109 | −1.099 | 0.379 |
| 1.947 | −1.279 | 0.379 |
| 2.598 | −1.826 | 0.379 |
| 2.628 | −1.664 | 0.379 |
| 2.391 | −1.405 | 0.379 |
| 2.720 | −1.827 | 0.379 |
| 2.710 | −1.754 | 0.379 |
| 2.241 | −1.241 | 0.379 |
| 2.543 | −1.776 | 0.379 |
| 2.720 | −1.768 | 0.379 |
| 2.673 | −1.861 | 0.379 |
| 2.726 | −1.787 | 0.379 |
| 1.961 | −0.941 | 0.379 |
| 2.655 | −1.694 | 0.379 |
| 2.486 | −1.726 | 0.379 |
| 2.653 | −1.861 | 0.379 |
| 2.683 | −1.725 | 0.379 |
| 2.669 | −1.709 | 0.379 |
| 2.373 | −1.627 | 0.379 |
| 2.634 | −1.855 | 0.379 |
| 2.708 | −1.843 | 0.379 |
| 1.829 | −0.803 | 0.379 |
| 2.692 | −1.855 | 0.379 |
| 2.697 | −1.740 | 0.379 |
| 2.726 | −1.808 | 0.379 |
| −2.071 | 0.450 | 0.483 |
| −2.126 | 0.424 | 0.483 |
| −2.181 | 0.397 | 0.483 |
| −2.235 | 0.369 | 0.483 |
| −2.289 | 0.340 | 0.483 |
| −2.344 | 0.316 | 0.483 |
| −2.363 | 0.309 | 0.483 |
| −2.381 | 0.305 | 0.483 |
| −2.401 | 0.303 | 0.483 |
| −2.420 | 0.306 | 0.483 |
| −2.437 | 0.314 | 0.483 |
| −2.451 | 0.325 | 0.483 |
| −2.462 | 0.339 | 0.483 |
| −2.471 | 0.356 | 0.483 |
| −2.472 | 0.374 | 0.483 |
| −2.468 | 0.391 | 0.483 |
| −2.460 | 0.408 | 0.483 |
| −2.451 | 0.424 | 0.483 |
| −2.440 | 0.439 | 0.483 |
| −2.410 | 0.477 | 0.483 |
| −2.377 | 0.512 | 0.483 |
| −2.341 | 0.546 | 0.483 |
| −2.276 | 0.602 | 0.483 |
| −2.207 | 0.653 | 0.483 |
| −2.136 | 0.701 | 0.483 |
| −2.062 | 0.745 | 0.483 |
| −1.642 | 0.585 | 0.483 |
| −1.742 | 0.564 | 0.483 |
| −1.835 | 0.539 | 0.483 |
| −1.926 | 0.509 | 0.483 |
| −1.543 | 0.957 | 0.483 |
| −2.015 | 0.474 | 0.483 |
| −1.437 | 0.982 | 0.483 |
| −1.752 | 0.891 | 0.483 |
| −1.987 | 0.787 | 0.483 |
| −1.649 | 0.927 | 0.483 |
| −1.910 | 0.825 | 0.483 |
| −1.336 | 0.615 | 0.483 |

TABLE I-continued

| X | Y | Z' |
|---|---|---|
| −1.438 | 0.611 | 0.483 |
| −1.540 | 0.601 | 0.483 |
| −1.832 | 0.860 | 0.483 |
| −0.779 | 1.008 | 0.483 |
| −0.666 | 0.990 | 0.483 |
| −0.554 | 0.965 | 0.483 |
| 0.132 | 0.100 | 0.483 |
| −0.444 | 0.934 | 0.483 |
| −0.336 | 0.897 | 0.483 |
| −0.229 | 0.854 | 0.483 |
| −1.329 | 1.001 | 0.483 |
| −1.221 | 1.015 | 0.483 |
| −0.011 | 0.194 | 0.483 |
| −0.135 | 0.268 | 0.483 |
| −0.261 | 0.337 | 0.483 |
| −0.116 | 0.801 | 0.483 |
| −0.006 | 0.743 | 0.483 |
| 0.102 | 0.679 | 0.483 |
| 0.206 | 0.610 | 0.483 |
| −1.112 | 1.023 | 0.483 |
| −0.390 | 0.399 | 0.483 |
| −0.522 | 0.456 | 0.483 |
| −0.636 | 0.498 | 0.483 |
| −0.753 | 0.535 | 0.483 |
| −1.003 | 1.024 | 0.483 |
| −0.871 | 0.565 | 0.483 |
| −0.991 | 0.588 | 0.483 |
| −1.111 | 0.605 | 0.483 |
| −1.233 | 0.613 | 0.483 |
| −0.893 | 1.020 | 0.483 |
| 1.571 | −1.098 | 0.483 |
| 0.272 | 0.002 | 0.483 |
| 1.789 | −1.293 | 0.483 |
| 1.595 | −0.733 | 0.483 |
| 1.295 | −0.397 | 0.483 |
| 1.682 | −1.197 | 0.483 |
| 1.464 | −1.003 | 0.483 |
| 1.508 | −0.634 | 0.483 |
| 0.308 | 0.538 | 0.483 |
| 0.408 | 0.462 | 0.483 |
| 0.505 | 0.383 | 0.483 |
| 1.725 | −0.882 | 0.483 |
| 1.005 | −0.088 | 0.483 |
| 1.206 | −0.300 | 0.483 |
| 1.246 | −0.809 | 0.483 |
| 1.027 | −0.616 | 0.483 |
| 0.807 | −0.425 | 0.483 |
| 0.635 | 0.271 | 0.483 |
| 0.761 | 0.154 | 0.483 |
| 1.356 | −0.907 | 0.483 |
| 0.884 | 0.035 | 0.483 |
| 1.402 | −0.515 | 0.483 |
| 0.676 | −0.315 | 0.483 |
| 0.544 | −0.207 | 0.483 |
| 0.409 | −0.101 | 0.483 |
| 2.537 | −1.828 | 0.483 |
| 2.433 | −1.887 | 0.483 |
| 2.381 | −1.836 | 0.483 |
| 2.499 | −1.784 | 0.483 |
| 2.328 | −1.786 | 0.483 |
| 2.222 | −1.685 | 0.483 |
| 2.486 | −1.769 | 0.483 |
| 2.008 | −1.489 | 0.483 |
| 2.359 | −1.621 | 0.483 |
| 2.115 | −1.586 | 0.483 |
| 1.899 | −1.391 | 0.483 |
| 2.105 | −1.324 | 0.483 |
| 2.550 | −1.876 | 0.483 |
| 2.234 | −1.475 | 0.483 |
| 1.851 | −1.028 | 0.483 |
| 2.550 | −1.858 | 0.483 |
| 2.544 | −1.893 | 0.483 |
| 1.976 | −1.174 | 0.483 |
| 2.545 | −1.841 | 0.483 |
| 2.511 | −1.799 | 0.483 |
| 2.518 | −1.918 | 0.483 |
| 2.524 | −1.814 | 0.483 |

TABLE I-continued

| X | Y | Z' |
|---|---|---|
| 2.501 | −1.923 | 0.483 |
| 2.482 | −1.922 | 0.483 |
| 2.533 | −1.908 | 0.483 |
| 2.466 | −1.916 | 0.483 |
| 2.450 | −1.904 | 0.483 |
| −1.785 | 0.671 | 0.586 |
| −1.875 | 0.647 | 0.586 |
| −1.917 | 0.633 | 0.586 |
| −2.318 | 0.622 | 0.586 |
| −2.311 | 0.637 | 0.586 |
| −1.959 | 0.620 | 0.586 |
| −2.090 | 0.815 | 0.586 |
| −2.001 | 0.605 | 0.586 |
| −2.043 | 0.590 | 0.586 |
| −2.084 | 0.574 | 0.586 |
| −2.301 | 0.652 | 0.586 |
| −2.290 | 0.665 | 0.586 |
| −2.126 | 0.558 | 0.586 |
| −2.007 | 0.859 | 0.586 |
| −2.167 | 0.543 | 0.586 |
| −2.210 | 0.532 | 0.586 |
| −2.234 | 0.530 | 0.586 |
| −2.278 | 0.678 | 0.586 |
| −2.244 | 0.710 | 0.586 |
| −1.922 | 0.899 | 0.586 |
| −1.835 | 0.934 | 0.586 |
| −2.257 | 0.532 | 0.586 |
| −2.272 | 0.536 | 0.586 |
| −2.286 | 0.545 | 0.586 |
| −2.207 | 0.739 | 0.586 |
| −2.297 | 0.556 | 0.586 |
| −2.304 | 0.568 | 0.586 |
| −2.310 | 0.581 | 0.586 |
| −2.316 | 0.594 | 0.586 |
| −2.169 | 0.766 | 0.586 |
| −2.319 | 0.608 | 0.586 |
| −1.332 | 1.054 | 0.586 |
| −1.213 | 1.064 | 0.586 |
| −1.747 | 0.965 | 0.586 |
| −1.657 | 0.992 | 0.586 |
| −1.107 | 0.714 | 0.586 |
| −1.206 | 0.723 | 0.586 |
| −1.567 | 1.014 | 0.586 |
| −1.450 | 1.038 | 0.586 |
| −1.306 | 0.726 | 0.586 |
| −1.094 | 1.067 | 0.586 |
| −1.405 | 0.725 | 0.586 |
| −1.504 | 0.718 | 0.586 |
| −1.603 | 0.707 | 0.586 |
| −1.695 | 0.691 | 0.586 |
| −0.422 | 0.948 | 0.586 |
| −0.321 | 0.908 | 0.586 |
| −0.221 | 0.863 | 0.586 |
| −0.975 | 1.063 | 0.586 |
| −0.124 | 0.813 | 0.586 |
| −0.021 | 0.753 | 0.586 |
| 0.080 | 0.689 | 0.586 |
| 0.177 | 0.621 | 0.586 |
| −0.856 | 1.052 | 0.586 |
| 0.187 | 0.144 | 0.586 |
| 0.053 | 0.243 | 0.586 |
| −0.062 | 0.321 | 0.586 |
| −0.181 | 0.394 | 0.586 |
| −0.302 | 0.461 | 0.586 |
| −0.738 | 1.034 | 0.586 |
| −0.427 | 0.523 | 0.586 |
| −0.536 | 0.569 | 0.586 |
| −0.647 | 0.610 | 0.586 |
| −0.760 | 0.646 | 0.586 |
| −0.874 | 0.675 | 0.586 |
| −0.632 | 1.011 | 0.586 |
| −0.990 | 0.698 | 0.586 |
| −0.526 | 0.982 | 0.586 |
| 1.194 | −0.819 | 0.586 |
| 0.999 | −0.614 | 0.586 |
| 0.801 | −0.412 | 0.586 |
| 0.684 | −0.295 | 0.586 |

TABLE I-continued

| X | Y | Z' |
|---|---|---|
| 1.345 | −0.593 | 0.586 |
| 0.564 | −0.180 | 0.586 |
| 0.442 | −0.068 | 0.586 |
| 0.316 | 0.040 | 0.586 |
| 0.989 | −0.165 | 0.586 |
| 0.271 | 0.548 | 0.586 |
| 0.363 | 0.472 | 0.586 |
| 0.453 | 0.394 | 0.586 |
| 1.169 | −0.377 | 0.586 |
| 0.541 | 0.312 | 0.586 |
| 0.657 | 0.197 | 0.586 |
| 0.771 | 0.079 | 0.586 |
| 1.093 | −0.713 | 0.586 |
| 0.881 | −0.042 | 0.586 |
| 1.287 | −0.917 | 0.586 |
| 2.323 | −1.835 | 0.586 |
| 1.862 | −1.248 | 0.586 |
| 2.284 | −1.960 | 0.586 |
| 2.379 | −1.939 | 0.586 |
| 2.269 | −1.943 | 0.586 |
| 2.337 | −1.853 | 0.586 |
| 1.389 | −1.024 | 0.586 |
| 1.677 | −1.323 | 0.586 |
| 2.207 | −1.689 | 0.586 |
| 2.253 | −1.925 | 0.586 |
| 2.172 | −1.839 | 0.586 |
| 2.351 | −1.872 | 0.586 |
| 2.366 | −1.889 | 0.586 |
| 2.075 | −1.735 | 0.586 |
| 1.518 | −0.810 | 0.586 |
| 1.638 | −0.962 | 0.586 |
| 1.978 | −1.633 | 0.586 |
| 2.372 | −1.955 | 0.586 |
| 2.376 | −1.905 | 0.586 |
| 1.438 | −0.710 | 0.586 |
| 2.347 | −1.977 | 0.586 |
| 2.330 | −1.981 | 0.586 |
| 1.748 | −1.103 | 0.586 |
| 1.781 | −1.431 | 0.586 |
| 2.093 | −1.544 | 0.586 |
| 2.313 | −1.979 | 0.586 |
| 2.298 | −1.972 | 0.586 |
| 1.978 | −1.396 | 0.586 |
| 1.885 | −1.538 | 0.586 |
| 1.584 | −1.228 | 0.586 |
| 2.380 | −1.922 | 0.586 |
| 2.361 | −1.968 | 0.586 |
| 1.490 | −1.130 | 0.586 |
| −2.153 | 0.816 | 0.690 |
| −2.157 | 0.829 | 0.690 |
| −2.114 | 0.919 | 0.690 |
| −2.078 | 0.945 | 0.690 |
| −1.780 | 0.839 | 0.690 |
| −1.828 | 0.829 | 0.690 |
| −1.876 | 0.818 | 0.690 |
| −2.160 | 0.843 | 0.690 |
| −2.161 | 0.856 | 0.690 |
| −2.040 | 0.969 | 0.690 |
| −2.001 | 0.990 | 0.690 |
| −1.924 | 0.806 | 0.690 |
| −1.971 | 0.794 | 0.690 |
| −2.019 | 0.781 | 0.690 |
| −2.158 | 0.869 | 0.690 |
| −2.149 | 0.883 | 0.690 |
| −1.920 | 1.028 | 0.690 |
| −1.836 | 1.060 | 0.690 |
| −2.067 | 0.773 | 0.690 |
| −2.090 | 0.773 | 0.690 |
| −2.112 | 0.776 | 0.690 |
| −2.138 | 0.896 | 0.690 |
| −2.127 | 0.782 | 0.690 |
| −2.138 | 0.791 | 0.690 |
| −2.147 | 0.804 | 0.690 |
| −2.126 | 0.908 | 0.690 |
| −1.554 | 0.871 | 0.690 |
| −1.643 | 0.862 | 0.690 |
| −1.732 | 0.848 | 0.690 |

TABLE I-continued

| X | Y | Z' |
|---|---|---|
| −1.399 | 1.152 | 0.690 |
| −1.285 | 1.158 | 0.690 |
| −1.171 | 1.158 | 0.690 |
| −1.751 | 1.087 | 0.690 |
| −1.664 | 1.109 | 0.690 |
| −1.103 | 0.854 | 0.690 |
| −1.576 | 1.128 | 0.690 |
| −1.488 | 1.142 | 0.690 |
| −1.223 | 0.869 | 0.690 |
| −1.343 | 0.876 | 0.690 |
| −1.464 | 0.876 | 0.690 |
| −0.140 | 0.835 | 0.690 |
| −0.053 | 0.777 | 0.690 |
| 0.054 | 0.698 | 0.690 |
| 0.210 | 0.161 | 0.690 |
| 0.090 | 0.267 | 0.690 |
| 0.158 | 0.615 | 0.690 |
| −0.015 | 0.353 | 0.690 |
| −1.057 | 1.152 | 0.690 |
| −0.123 | 0.434 | 0.690 |
| −0.234 | 0.510 | 0.690 |
| −0.943 | 1.139 | 0.690 |
| −0.349 | 0.580 | 0.690 |
| −0.831 | 1.119 | 0.690 |
| −0.449 | 0.636 | 0.690 |
| −0.552 | 0.686 | 0.690 |
| −0.657 | 0.731 | 0.690 |
| −0.720 | 1.093 | 0.690 |
| −0.764 | 0.771 | 0.690 |
| −0.611 | 1.061 | 0.690 |
| −0.874 | 0.804 | 0.690 |
| −0.512 | 1.025 | 0.690 |
| −0.985 | 0.832 | 0.690 |
| −0.416 | 0.985 | 0.690 |
| −0.322 | 0.939 | 0.690 |
| −0.230 | 0.889 | 0.690 |
| 0.550 | −0.181 | 0.690 |
| 1.178 | −0.550 | 0.690 |
| 0.440 | −0.064 | 0.690 |
| 0.327 | 0.050 | 0.690 |
| 0.258 | 0.527 | 0.690 |
| 0.883 | −0.558 | 0.690 |
| 0.354 | 0.435 | 0.690 |
| 0.448 | 0.340 | 0.690 |
| 1.115 | −0.830 | 0.690 |
| 0.539 | 0.243 | 0.690 |
| 0.674 | 0.090 | 0.690 |
| 1.362 | −1.122 | 0.690 |
| 1.300 | −0.713 | 0.690 |
| 0.804 | −0.067 | 0.690 |
| 0.931 | −0.226 | 0.690 |
| 1.055 | −0.387 | 0.690 |
| 1.238 | −0.976 | 0.690 |
| 1.002 | −0.698 | 0.690 |
| 0.764 | −0.420 | 0.690 |
| 0.658 | −0.300 | 0.690 |
| 1.567 | −1.361 | 0.690 |
| 2.197 | −1.960 | 0.690 |
| 2.188 | −1.944 | 0.690 |
| 1.735 | −1.310 | 0.690 |
| 1.839 | −1.455 | 0.690 |
| 2.097 | −1.817 | 0.690 |
| 1.942 | −1.599 | 0.690 |
| 2.178 | −2.022 | 0.690 |
| 1.533 | −1.031 | 0.690 |
| 1.630 | −1.165 | 0.690 |
| 2.046 | −1.745 | 0.690 |
| 2.198 | −1.995 | 0.690 |
| 2.190 | −2.010 | 0.690 |
| 2.039 | −1.930 | 0.690 |
| 2.163 | −2.030 | 0.690 |
| 2.149 | −1.890 | 0.690 |
| 2.175 | −1.926 | 0.690 |
| 2.146 | −2.033 | 0.690 |
| 2.129 | −2.030 | 0.690 |
| 2.200 | −1.977 | 0.690 |
| 2.114 | −2.023 | 0.690 |

TABLE I-continued

| X | Y | Z' |
|---|---|---|
| 2.101 | −2.009 | 0.690 |
| 2.088 | −1.991 | 0.690 |
| 1.960 | −1.831 | 0.690 |
| 2.162 | −1.908 | 0.690 |
| 2.074 | −1.973 | 0.690 |
| 2.003 | −1.883 | 0.690 |
| 1.420 | −0.877 | 0.690 |
| 1.917 | −1.777 | 0.690 |
| 1.990 | −1.667 | 0.690 |
| 1.830 | −1.671 | 0.690 |
| 1.653 | −1.462 | 0.690 |
| 1.873 | −1.723 | 0.690 |
| 1.739 | −1.564 | 0.690 |
| 1.475 | −1.254 | 0.690 |
| −1.567 | 1.286 | 0.793 |
| −1.482 | 1.296 | 0.793 |
| −1.978 | 1.127 | 0.793 |
| −1.981 | 1.076 | 0.793 |
| −1.968 | 1.139 | 0.793 |
| −1.983 | 1.089 | 0.793 |
| −1.673 | 1.060 | 0.793 |
| −1.813 | 1.038 | 0.793 |
| −1.978 | 1.063 | 0.793 |
| −1.397 | 1.300 | 0.793 |
| −1.311 | 1.301 | 0.793 |
| −1.956 | 1.150 | 0.793 |
| −1.943 | 1.159 | 0.793 |
| −1.984 | 1.102 | 0.793 |
| −1.578 | 1.068 | 0.793 |
| −1.720 | 1.053 | 0.793 |
| −1.766 | 1.046 | 0.793 |
| −1.860 | 1.030 | 0.793 |
| −1.117 | 1.285 | 0.793 |
| −1.929 | 1.026 | 0.793 |
| −1.930 | 1.168 | 0.793 |
| −1.893 | 1.189 | 0.793 |
| −1.625 | 1.065 | 0.793 |
| −1.491 | 1.071 | 0.793 |
| −1.973 | 1.049 | 0.793 |
| −1.855 | 1.208 | 0.793 |
| −1.405 | 1.069 | 0.793 |
| −1.816 | 1.224 | 0.793 |
| −1.225 | 1.051 | 0.793 |
| −1.318 | 1.063 | 0.793 |
| −1.907 | 1.025 | 0.793 |
| −1.134 | 1.034 | 0.793 |
| −1.735 | 1.251 | 0.793 |
| −1.651 | 1.271 | 0.793 |
| −1.983 | 1.115 | 0.793 |
| −1.950 | 1.031 | 0.793 |
| −1.226 | 1.297 | 0.793 |
| −1.963 | 1.038 | 0.793 |
| −0.395 | 1.025 | 0.793 |
| 0.207 | 0.525 | 0.793 |
| −0.379 | 0.696 | 0.793 |
| 0.101 | 0.285 | 0.793 |
| 0.008 | 0.376 | 0.793 |
| −0.294 | 0.960 | 0.793 |
| −0.197 | 0.890 | 0.793 |
| −0.087 | 0.465 | 0.793 |
| 0.229 | 0.149 | 0.793 |
| −0.186 | 0.550 | 0.793 |
| −1.010 | 1.267 | 0.793 |
| −0.289 | 0.631 | 0.793 |
| −0.103 | 0.816 | 0.793 |
| −0.764 | 0.913 | 0.793 |
| −0.904 | 1.242 | 0.793 |
| −0.664 | 0.866 | 0.793 |
| −0.800 | 1.211 | 0.793 |
| −0.697 | 1.174 | 0.793 |
| −0.471 | 0.757 | 0.793 |
| −0.566 | 0.813 | 0.793 |
| −0.012 | 0.738 | 0.793 |
| −0.597 | 1.132 | 0.793 |
| −0.866 | 0.955 | 0.793 |
| −0.499 | 1.083 | 0.793 |
| −0.954 | 0.985 | 0.793 |

TABLE I-continued

| X | Y | Z' |
|---|---|---|
| −1.043 | 1.012 | 0.793 |
| 0.100 | 0.634 | 0.793 |
| 1.177 | −0.736 | 0.793 |
| 0.705 | −0.425 | 0.793 |
| 0.589 | −0.279 | 0.793 |
| 0.309 | 0.412 | 0.793 |
| 1.307 | −0.922 | 0.793 |
| 1.027 | −0.842 | 0.793 |
| 0.409 | 0.297 | 0.793 |
| 0.506 | 0.179 | 0.793 |
| 0.814 | −0.566 | 0.793 |
| 0.646 | 0.000 | 0.793 |
| 0.782 | −0.182 | 0.793 |
| 0.916 | −0.365 | 0.793 |
| 0.472 | −0.134 | 0.793 |
| 0.353 | 0.009 | 0.793 |
| 1.246 | −1.125 | 0.793 |
| 1.353 | −1.263 | 0.793 |
| 1.136 | −0.984 | 0.793 |
| 1.047 | −0.550 | 0.793 |
| 0.921 | −0.705 | 0.793 |
| 1.885 | −1.978 | 0.793 |
| 1.917 | −2.025 | 0.793 |
| 2.015 | −2.015 | 0.793 |
| 1.994 | −2.042 | 0.793 |
| 1.786 | −1.632 | 0.793 |
| 1.499 | −1.203 | 0.793 |
| 1.689 | −1.486 | 0.793 |
| 1.878 | −1.769 | 0.793 |
| 1.408 | −1.070 | 0.793 |
| 1.790 | −1.843 | 0.793 |
| 2.015 | −1.980 | 0.793 |
| 1.867 | −1.952 | 0.793 |
| 1.961 | −2.051 | 0.793 |
| 1.944 | −2.048 | 0.793 |
| 1.929 | −2.039 | 0.793 |
| 1.971 | −1.911 | 0.793 |
| 1.983 | −1.929 | 0.793 |
| 1.711 | −1.733 | 0.793 |
| 1.591 | −1.340 | 0.793 |
| 1.905 | −2.007 | 0.793 |
| 1.829 | −1.898 | 0.793 |
| 1.601 | −1.585 | 0.793 |
| 1.839 | −1.710 | 0.793 |
| 1.428 | −1.360 | 0.793 |
| 1.848 | −1.925 | 0.793 |
| 1.674 | −1.683 | 0.793 |
| 2.007 | −2.030 | 0.793 |
| 1.515 | −1.472 | 0.793 |
| 2.007 | −1.963 | 0.793 |
| 1.948 | −1.875 | 0.793 |
| 1.917 | −1.827 | 0.793 |
| 1.753 | −1.790 | 0.793 |
| 1.959 | −1.892 | 0.793 |
| 2.018 | −1.998 | 0.793 |
| 1.995 | −1.946 | 0.793 |
| 1.979 | −2.050 | 0.793 |
| −1.110 | 1.439 | 0.897 |
| −1.180 | 1.454 | 0.897 |
| −1.736 | 1.404 | 0.897 |
| −1.464 | 1.473 | 0.897 |
| −1.725 | 1.281 | 0.897 |
| −1.250 | 1.465 | 0.897 |
| −1.321 | 1.472 | 0.897 |
| −1.767 | 1.378 | 0.897 |
| −1.719 | 1.414 | 0.897 |
| −1.535 | 1.466 | 0.897 |
| −1.545 | 1.282 | 0.897 |
| −1.604 | 1.453 | 0.897 |
| −1.745 | 1.287 | 0.897 |
| −1.776 | 1.349 | 0.897 |
| −1.142 | 1.222 | 0.897 |
| −1.222 | 1.244 | 0.897 |
| −1.775 | 1.333 | 0.897 |
| −1.758 | 1.294 | 0.897 |
| −1.304 | 1.261 | 0.897 |
| −1.386 | 1.273 | 0.897 |

TABLE I-continued

| X | Y | Z' |
|---|---|---|
| −1.393 | 1.475 | 0.897 |
| −1.492 | 1.281 | 0.897 |
| −1.773 | 1.317 | 0.897 |
| −1.704 | 1.278 | 0.897 |
| −1.682 | 1.430 | 0.897 |
| −1.598 | 1.281 | 0.897 |
| −1.643 | 1.443 | 0.897 |
| −1.439 | 1.278 | 0.897 |
| −1.651 | 1.278 | 0.897 |
| −1.753 | 1.392 | 0.897 |
| −1.774 | 1.365 | 0.897 |
| −1.767 | 1.304 | 0.897 |
| −0.737 | 1.037 | 0.897 |
| −0.234 | 0.933 | 0.897 |
| −0.943 | 1.389 | 0.897 |
| −0.152 | 0.854 | 0.897 |
| −1.042 | 1.421 | 0.897 |
| −0.073 | 0.772 | 0.897 |
| 0.004 | 0.688 | 0.897 |
| −0.663 | 1.256 | 0.897 |
| −0.428 | 0.814 | 0.897 |
| 0.122 | 0.551 | 0.897 |
| −0.575 | 1.202 | 0.897 |
| −0.319 | 1.009 | 0.897 |
| −0.974 | 1.160 | 0.897 |
| 0.100 | 0.278 | 0.897 |
| −1.057 | 1.193 | 0.897 |
| −0.009 | 0.404 | 0.897 |
| −0.489 | 1.144 | 0.897 |
| −0.407 | 1.081 | 0.897 |
| −0.847 | 1.350 | 0.897 |
| −0.754 | 1.306 | 0.897 |
| −0.122 | 0.526 | 0.897 |
| −0.239 | 0.644 | 0.897 |
| −0.332 | 0.731 | 0.897 |
| −0.527 | 0.894 | 0.897 |
| −0.630 | 0.968 | 0.897 |
| −0.893 | 1.123 | 0.897 |
| −0.814 | 1.082 | 0.897 |
| 1.234 | −1.253 | 0.897 |
| 0.743 | −0.280 | 0.897 |
| 0.937 | −0.842 | 0.897 |
| 0.641 | −0.431 | 0.897 |
| 0.510 | −0.251 | 0.897 |
| 0.377 | −0.072 | 0.897 |
| 1.347 | −1.410 | 0.897 |
| 0.241 | 0.105 | 0.897 |
| 1.157 | −1.146 | 0.897 |
| 1.012 | −0.672 | 0.897 |
| 0.237 | 0.411 | 0.897 |
| 1.311 | −1.360 | 0.897 |
| 0.347 | 0.267 | 0.897 |
| 0.455 | 0.122 | 0.897 |
| 1.083 | −1.045 | 0.897 |
| 1.282 | −1.079 | 0.897 |
| 1.100 | −0.804 | 0.897 |
| 0.829 | −0.405 | 0.897 |
| 0.792 | −0.640 | 0.897 |
| 1.191 | −0.941 | 0.897 |
| 0.644 | −0.140 | 0.897 |
| 0.916 | −0.531 | 0.897 |
| 0.553 | −0.012 | 0.897 |
| 1.669 | −1.876 | 0.897 |
| 1.527 | −1.666 | 0.897 |
| 1.635 | −1.825 | 0.897 |
| 1.419 | −1.511 | 0.897 |
| 1.720 | −1.754 | 0.897 |
| 1.382 | −1.459 | 0.897 |
| 1.406 | −1.269 | 0.897 |
| 1.637 | −1.627 | 0.897 |
| 1.600 | −1.772 | 0.897 |
| 1.851 | −1.974 | 0.897 |
| 1.564 | −1.720 | 0.897 |
| 1.497 | −1.408 | 0.897 |
| 1.452 | −1.338 | 0.897 |
| 1.826 | −2.018 | 0.897 |
| 1.488 | −1.609 | 0.897 |

TABLE I-continued

| X | Y | Z' |
|---|---|---|
| 1.686 | −1.902 | 0.897 |
| 1.545 | −1.482 | 0.897 |
| 1.785 | −1.856 | 0.897 |
| 1.721 | −1.954 | 0.897 |
| 1.793 | −2.026 | 0.897 |
| 1.776 | −2.022 | 0.897 |
| 1.750 | −1.801 | 0.897 |
| 1.762 | −2.013 | 0.897 |
| 1.839 | −2.006 | 0.897 |
| 1.840 | −1.940 | 0.897 |
| 1.829 | −1.924 | 0.897 |
| 1.593 | −1.557 | 0.897 |
| 1.848 | −1.991 | 0.897 |
| 1.369 | −1.211 | 0.897 |
| 1.750 | −1.999 | 0.897 |
| 1.848 | −1.957 | 0.897 |
| 1.810 | −2.025 | 0.897 |
| 1.739 | −1.982 | 0.897 |
| 1.704 | −1.929 | 0.897 |
| 1.818 | −1.907 | 0.897 |
| 1.807 | −1.890 | 0.897 |
| 1.454 | −1.560 | 0.897 |
| −1.211 | 1.672 | 1.000 |
| −1.482 | 1.674 | 1.000 |
| −1.419 | 1.687 | 1.000 |
| −1.519 | 1.563 | 1.000 |
| −1.320 | 1.520 | 1.000 |
| −1.247 | 1.497 | 1.000 |
| −1.531 | 1.646 | 1.000 |
| −1.097 | 1.639 | 1.000 |
| −1.387 | 1.689 | 1.000 |
| −1.153 | 1.657 | 1.000 |
| −1.533 | 1.568 | 1.000 |
| −1.359 | 1.690 | 1.000 |
| −1.450 | 1.682 | 1.000 |
| −1.544 | 1.577 | 1.000 |
| −1.470 | 1.552 | 1.000 |
| −1.394 | 1.538 | 1.000 |
| −1.543 | 1.632 | 1.000 |
| −1.487 | 1.555 | 1.000 |
| −1.516 | 1.658 | 1.000 |
| −1.432 | 1.545 | 1.000 |
| −1.551 | 1.589 | 1.000 |
| −1.106 | 1.437 | 1.000 |
| −1.328 | 1.689 | 1.000 |
| −1.269 | 1.682 | 1.000 |
| −1.499 | 1.667 | 1.000 |
| −1.553 | 1.604 | 1.000 |
| −1.357 | 1.530 | 1.000 |
| −1.504 | 1.559 | 1.000 |
| −1.175 | 1.469 | 1.000 |
| −1.550 | 1.619 | 1.000 |
| −0.722 | 1.168 | 1.000 |
| −0.538 | 1.262 | 1.000 |
| −0.268 | 0.964 | 1.000 |
| −0.172 | 0.847 | 1.000 |
| −0.886 | 1.301 | 1.000 |
| −0.431 | 0.875 | 1.000 |
| −0.988 | 1.593 | 1.000 |
| −0.936 | 1.566 | 1.000 |
| −0.611 | 1.331 | 1.000 |
| 0.074 | 0.523 | 1.000 |
| 0.220 | 0.048 | 1.000 |
| −0.535 | 0.987 | 1.000 |
| −0.366 | 1.079 | 1.000 |
| −0.687 | 1.396 | 1.000 |
| −0.330 | 0.758 | 1.000 |
| 0.141 | 0.155 | 1.000 |
| −1.042 | 1.617 | 1.000 |
| −0.644 | 1.096 | 1.000 |
| −0.468 | 1.190 | 1.000 |
| −0.135 | 0.519 | 1.000 |
| −0.041 | 0.397 | 1.000 |
| −1.038 | 1.400 | 1.000 |
| −0.080 | 0.728 | 1.000 |
| −0.849 | 1.515 | 1.000 |
| −0.802 | 1.236 | 1.000 |

TABLE I-continued

| X | Y | Z' |
|---|---|---|
| −0.766 | 1.458 | 1.000 |
| 0.224 | 0.315 | 1.000 |
| 0.052 | 0.275 | 1.000 |
| −0.231 | 0.640 | 1.000 |
| −0.973 | 1.360 | 1.000 |
| 0.682 | −0.595 | 1.000 |
| 1.359 | −1.362 | 1.000 |
| 1.144 | −1.030 | 1.000 |
| 0.605 | −0.229 | 1.000 |
| 1.105 | −1.197 | 1.000 |
| 1.062 | −0.906 | 1.000 |
| 0.711 | −0.384 | 1.000 |
| 0.829 | −0.802 | 1.000 |
| 1.040 | −1.104 | 1.000 |
| 0.372 | 0.106 | 1.000 |
| 0.748 | −0.688 | 1.000 |
| 0.386 | −0.181 | 1.000 |
| 0.910 | −0.917 | 1.000 |
| 0.975 | −1.011 | 1.000 |
| 0.307 | −0.072 | 1.000 |
| 1.339 | −1.542 | 1.000 |
| 1.303 | −1.488 | 1.000 |
| 0.465 | −0.290 | 1.000 |
| 0.835 | −0.567 | 1.000 |
| 0.958 | −0.750 | 1.000 |
| 1.272 | −1.227 | 1.000 |
| 1.188 | −1.097 | 1.000 |
| 0.490 | −0.063 | 1.000 |
| 0.616 | −0.502 | 1.000 |
| 1.316 | −1.295 | 1.000 |
| 1.171 | −1.294 | 1.000 |
| 1.303 | −1.488 | 1.000 |
| 0.465 | −0.290 | 1.000 |
| 0.835 | −0.567 | 1.000 |
| 0.958 | −0.750 | 1.000 |
| 1.272 | −1.227 | 1.000 |
| 1.188 | −1.097 | 1.000 |
| 0.490 | −0.063 | 1.000 |
| 0.616 | −0.502 | 1.000 |
| 1.316 | −1.295 | 1.000 |
| 1.171 | −1.294 | 1.000 |
| 1.230 | −1.162 | 1.000 |
| 1.241 | −1.396 | 1.000 |
| 0.551 | −0.410 | 1.000 |
| 1.681 | −1.871 | 1.000 |
| 1.477 | −1.749 | 1.000 |
| 1.590 | −1.723 | 1.000 |
| 1.574 | −1.896 | 1.000 |
| 1.410 | −1.648 | 1.000 |
| 1.644 | −1.938 | 1.000 |
| 1.433 | −1.477 | 1.000 |
| 1.672 | −1.920 | 1.000 |
| 1.532 | −1.632 | 1.000 |
| 1.684 | −1.888 | 1.000 |
| 1.375 | −1.595 | 1.000 |
| 1.653 | −1.823 | 1.000 |
| 1.557 | −1.871 | 1.000 |
| 1.494 | −1.572 | 1.000 |
| 1.524 | −1.821 | 1.000 |
| 1.507 | −1.796 | 1.000 |
| 1.396 | −1.419 | 1.000 |
| 1.610 | −1.936 | 1.000 |
| 1.674 | −1.855 | 1.000 |
| 1.596 | −1.927 | 1.000 |
| 1.681 | −1.905 | 1.000 |
| 1.446 | −1.702 | 1.000 |
| 1.660 | −1.931 | 1.000 |
| 1.663 | −1.839 | 1.000 |
| 1.643 | −1.807 | 1.000 |
| 1.614 | −1.761 | 1.000 |
| 1.541 | −1.846 | 1.000 |
| 1.561 | −1.678 | 1.000 |
| 1.627 | −1.940 | 1.000 |
| 1.584 | −1.913 | 1.000 |
| 1.459 | −1.518 | 1.000 |

It will also be appreciated that the airfoil disclosed in the above table may be scaled up or down geometrically for use in other similar turbine designs. Consequently, the coordinate values set forth in Table I may be scaled upwardly or downwardly such that the airfoil section shape remains unchanged. A scaled version of the coordinates in Table I would be represented by X, Y and Z coordinate distances (after the Z values have been converted to inches) multiplied or divided by the same constant or number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket including an airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each distance Z, the profile sections at the Z distances being joined smoothly with one another to form a complete airfoil shape.

2. A turbine bucket according to claim 1 forming part of a third stage of a turbine.

3. A turbine bucket according to claim 1 wherein the airfoil has a height from a root radius of 21.46 inches.

4. A turbine bucket according to claim 3 wherein said bucket has a root radius of 44.010 inches.

5. A turbine bucket according to claim 1 wherein said airfoil shape lies in an envelope within ±0.160 inches in a direction normal to any airfoil surface location.

6. A turbine bucket including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each Z distance, the profile sections at the Z distances being joined smoothly with one another to form a complete airfoil shape, the X, Y and Z distances being scalable as a function of the same constant or number to provide a scaled-up or scaled-down airfoil.

7. A turbine bucket according to claim 6 forming part of a third stage of a turbine.

8. A turbine bucket according to claim 6 wherein the airfoil bucket has a root radius of 44.010 inches and a height from the root radius of 21.46 inches, said bucket forming part of a third stage of a turbine.

9. A turbine bucket according to claim 6 wherein said airfoil shape lies in an envelope within ±0.160 inches in a direction normal to any airfoil surface location.

10. A turbine comprising a turbine wheel having a plurality of buckets, each of said buckets including an airfoil having an airfoil shape, said airfoil having a nominal profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define the airfoil profile sections at each distance Z, the profile sections at the Z distances being joined smoothly with one another to form a complete airfoil shape.

11. A turbine according to claim 10 wherein the turbine wheel comprises a third stage of the turbine.

12. A turbine according to claim 10 wherein the turbine wheel has 92 buckets and Y represents a distance parallel to the turbine axis of rotation.

13. A turbine according to claim 10 wherein each airfoil bucket has a root radius of 44.010 inches and a height from the root radius of 21.46 inches, said turbine wheel comprising a third stage of the turbine.

14. A turbine comprising a turbine wheel having a plurality of buckets, each of said buckets including an airfoil having an uncoated nominal airfoil profile substantially in accordance with Cartesian coordinate values of X, Y and Z set forth in Table I wherein the Z values are non-dimensional values from 0 to 1 convertible to Z distances in inches by multiplying the Z values by a height of the airfoil, and wherein X and Y are distances in inches which, when connected by smooth continuing arcs, define airfoil profile sections at each distance Z, the profile sections at the Z distances being joined smoothly with one another to form a complete airfoil shape, the X, Y and Z distances being scalable as a function of the same constant or number to provide a scaled-up or scaled-down bucket airfoil.

15. A turbine according to claim 14 wherein the turbine wheel comprises a third stage of the turbine.

16. A turbine according to claim 14 wherein the turbine wheel has 92 buckets and Y represents a distance parallel to the turbine axis of rotation.

17. A turbine according to claim 14 wherein each airfoil bucket has a root radius of 44.010 inches and a height from the root radius of 21.46 inches, said turbine wheel comprising a third stage of the turbine.

* * * * *

UNITED STATES PATENT AND TRADEMARK OFFICE

CERTIFICATE OF CORRECTION

PATENT NO. : 6,722,852 B1
DATED : April 20, 2004
INVENTOR(S) : Wedlake et al.

It is certified that error appears in the above-identified patent and that said Letters Patent is hereby corrected as shown below:

Column 33,
Table I, after 23rd row of X, Y, and Z coordinates reading "1.905 -1.988 0.862", insert the additional row reading -- 1.721 -1.888 0.862 --

Column 38,
Line 18, 16th row of Y coordinates, delete "-1.388" and insert -- -1.380 --

Column 48,
Line 15, after 11th row from bottom of X, Y, and Z coordinates reading "1.720 -1.754 0.897", insert additional row reading -- 1.682 -1.696 0.897 --

Column 50,
Lines 29-35, delete 32nd through 41st rows of X, Y, and Z coordinates reading "1.303 -1.488 1.000
0.465 -0.290 1.000
0.835 -0.567 1.000
0.958 -0.750 1.000
1.272 -1.227 1.000
1.188 -1.097 1.000
0.490 -0.063 1.000
0.616 -0.502 1.000
1.316 -1.295 1.000
1.171 -1.294 1.000"

Signed and Sealed this

Sixth Day of July, 2004

JON W. DUDAS
*Acting Director of the United States Patent and Trademark Office*